US008210610B2

(12) United States Patent
Berkey et al.

(10) Patent No.: US 8,210,610 B2
(45) Date of Patent: Jul. 3, 2012

(54) RECONFIGURABLE CHILD SEAT ASSEMBLY FOR A JUVENILE PRODUCT

(75) Inventors: Cindy L. Berkey, Honey Brook, PA (US); John (Jason) C. Arnold, IV, Philadelphia, PA (US)

(73) Assignee: Graco Children's Products Inc., Atlanta, GA (US)

( * ) Notice: Subject to any disclaimer, the term of this patent is extended or adjusted under 35 U.S.C. 154(b) by 394 days.

(21) Appl. No.: 12/498,241

(22) Filed: Jul. 6, 2009

(65) Prior Publication Data

US 2010/0231019 A1 Sep. 16, 2010

Related U.S. Application Data

(60) Provisional application No. 61/160,378, filed on Mar. 16, 2009.

(51) Int. Cl.
*A47D 1/10* (2006.01)
*A47D 1/04* (2006.01)

(52) U.S. Cl. .... 297/256.1; 297/3; 297/467; 297/219.12; 297/245.14; 297/174 CS

(58) Field of Classification Search ..... 297/1, 3, 297/92, 93, 219, 12, 256.1, 256.13, 256.14, 297/174 CS, DIG. 11
See application file for complete search history.

(56) References Cited

U.S. PATENT DOCUMENTS 2,493,187 A * 1/1950 Ducey ..... 297/174 CS
3,934,934 A * 1/1976 Farrell et al. ..... 297/467
4,510,634 A * 4/1985 Diedrich et al. ..... 5/98.3
4,516,806 A * 5/1985 McDonald et al. ..... 297/452.13
4,568,125 A * 2/1986 Sckolnik ..... 297/467
5,127,120 A * 7/1992 Mason ..... 5/655
5,415,456 A * 5/1995 Hart et al. ..... 297/174 CS
5,470,127 A * 11/1995 Kassai et al. ..... 297/174 CS
6,247,755 B1 * 6/2001 Canna et al. ..... 297/468

(Continued)

FOREIGN PATENT DOCUMENTS

GB 2223717 A * 4/1990

OTHER PUBLICATIONS

Instruction Manual for Chicco Hippo and Caddy Hook-on Chairs, 18 pages, admitted prior art.

(Continued)

*Primary Examiner* — David Dunn
*Assistant Examiner* — Tania Abraham
(74) *Attorney, Agent, or Firm* — Lempia Summerfield Katz LLC

(57) ABSTRACT

A child seat for a juvenile product has a seating surface with a first section, a second section, and a seat bight region between the first and second sections. A lap belt is coupled to the child seat near the seat bight region. A first crotch strap is coupled to the child seat on the first section side of the seat bight region and is connectable to the lap belt in a first harness configuration rendering the first section as the seat bottom of the seating surface. The child seat has a removable pad insert with a second crotch strap. With the pad insert installed over the first section of the seating surface, the pad insert positions the second crotch strap on the second section side of the seat bight region. The second crotch strap is connectable to the lap belt in a second harness configuration rendering the second section as the seat bottom of the seating surface.

17 Claims, 17 Drawing Sheets

U.S. PATENT DOCUMENTS

| | | | | |
|---|---|---|---|---|
| 6,341,818 | B1 * | 1/2002 | Verbovszky et al. | 297/219.12 |
| 6,467,840 | B1 * | 10/2002 | Verbovszky et al. | 297/219.12 |
| 6,481,794 | B1 * | 11/2002 | Kassai et al. | 297/250.1 |
| 6,877,761 | B2 * | 4/2005 | Hsia | 280/642 |
| 6,880,850 | B2 * | 4/2005 | Hsia | 280/642 |
| 7,909,400 | B1 * | 3/2011 | Delaney et al. | 297/256.16 |
| 2007/0040430 | A1 | 2/2007 | Flannery | |
| 2007/0170759 | A1 * | 7/2007 | Nolan et al. | 297/250.1 |

OTHER PUBLICATIONS

Instruction Manual for Munchkin Feeding Friend Portable Hook-on Chair, 17 pages, (2007).

Instruction Manual for Inglesina Fast Table Chair, 36 pages, (Aug. 2008).

Product Information for Graco Travel Lite Table Chair from www.BabyGenie.com, 2 pages, admitted prior art.

Owner's Manual for Regalo Easy Diner Hook-on Chair, 10 pages, (2008).

Product information for Phil & Teds Me Too Hook-on Chair, 2 pages, admitted prior art.

Product Data Sheet and User Guide for Zooper Hook-on Chair, 12 pages, admitted prior art.

Annex to Form PCT/ISA/206 issued in related International application No. PCT/US2009/060106 mailed Apr. 28, 2010.

* cited by examiner

RECONFIGURABLE CHILD SEAT ASSEMBLY FOR A JUVENILE PRODUCT

RELATED APPLICATION DATA

This patent is related to and claims priority benefit of U.S. provisional patent application Ser. No. 61/160,378 filed on Mar. 16, 2009 and entitled "Convertible Child Seat for Feeding," the entirety of which is incorporated herein by reference.

BACKGROUND

1. Field of the Disclosure

The present disclosure is generally directed to child seating devices, and more particularly to a convertible child seat that can be reconfigured between a plurality of different optional seating arrangements.

2. Description of Related Art

Many different types of child seating devices are known in the art. For example, bouncer seats for young infants are known and include a relatively simple bouncer frame. A suspended seat or sling-type seating surface, to which the infant can be secured by a harness, is coupled to the frame. Highchairs are known in the art as a child feeding solution and include a relatively tall frame supporting a child seat. The seat typically has a tray to support food items, dishes, eating implements, and the like. The child can eat directly from the tray or the caregiver can place food and other implements on the tray in order to feed their child. Highchairs can be used for young children, but only after they reach an age where they can sit up and hold their head up on their own. A highchair can be used until the child is big enough to sit at a regular size table with the family and use a booster seat.

For larger children and toddlers, booster seats are also known in the art. A typical booster seat provides an intermediate seating surface to be placed on the seat of a conventional chair. The booster raises the seat bottom height so that the child can sit comfortably and access the top of the table. The child can thus sit at the table and eat from the standard tabletop surface. Booster seats come in many different sizes, constructions, and variations, but are typically for older children.

Many of these types of seating devices are used by parents both in the home and outside the home at restaurants, diners, and the like. The goal for these types of devices is to integrate the child as soon as possible in an affective manner with the rest of the family during meals. These conventional devices require parents to obtain and store several different products to accommodate a single child as the child grows from a young infant stage to the toddler stage and beyond.

Safety is a concern when it comes to the design and use of these types of seating devices. Many such products come with built-in seat belts, safety harnesses, and the like for restraining the infant or child in the seat of the device. A number of these devices also come with other safety features that assist in securing the seating device to another object, such as the chair or table. Some families utilize a conventional bouncer seat or an infant carrier placed directly on a tabletop surface for feeding their very young child or for integrating their infant into the family dynamic during meals, even if the infant is not being fed. Placing a bouncer or carrier directly on the tabletop is not particularly safe, as a conventional bouncer and carrier have no means of securing the seating device to the table.

A number of companies have produced and sold seats for toddlers that can hook or attach onto another object, such as an edge of a table. These types of products include the "Caddy/Explorer" by Chicco, the "Feeding Friend (Dog)" by Munchkins, the "Rubino/Limone" by Inglesina, the "Travel Lite" by Graco, the "Hook on Chair" by Regalo, the "Me Too Hook on Chair" by Phil and Ted, and the "Hook on Chair" by Zooper. A number of these products include safety restraint and harness systems, table attachment systems, a seat providing a feeding position for the child, and a tray placed in front of the seat. The Chicco product has a locked upright seat position, a three-point harness system, and a double locking hook system to attach the product to a table edge. The Munchkins product also has a single locked upright seat position, a three-point harness system, and a ratcheting under body attachment system for connecting the seat to a table edge. The Inglesina product also has a locked upright seating position, a three-point harness, and a ratcheting under body attachment system. The Phil and Ted product similarly has a locked upright seat position and a three-point restraint system for the seat. The Zooper product has a four-point harness system, a fabric crotch pad, and a spring loaded locking clamp for connecting the chair to a table edge.

These types of alternative booster seats attach to the table with the seat or chair suspended from the table's edge. The child can use the table top or, in some instances, a tray of the product for an eating surface. These products do not eliminate the need for a young infant feeding solution. Thus, a family will still likely have a number of child seat products on hand to accommodate their child as the child grows.

SUMMARY

In one example, a child seat for a juvenile product according to the present invention can have a seating surface with a first end, a second end, a seat bight, a first section between the first end and the seat bight, and a second section between the second end and the seat bight. The child seat can have a lap belt extendable from the seating surface and a first crotch strap extendable from the seating surface and connectable to the lap belt in a first harness configuration positioned between the first end and the seat bight. The child seat can have a removable pad insert with a second crotch strap extending therefrom. With the pad insert installed on the child seat, the second crotch strap can be connectable to the lap belt in a second harness configuration positioned between the second end and the lap belt. The first harness configuration can secure a child in the child seat with the first section as a seat bottom and the second section as a seat back. With the pad insert installed on the child seat, the second harness configuration can secure a child with the second section as the seat bottom and the first section as the seat back.

In one example, a child seat according to the invention can have a seating surface that is formed by a fabric material suspended from a seat frame of the child seat.

In one example, a child seat according to the invention can have two separate belt straps that form the lap belt.

In one example, a child seat according to the invention can have two separate belt straps, each connectable to the first crotch strap and to the second crotch strap.

In one example, a child seat according to the invention can have two separate belt straps and a belt connector on an end of each belt strap. The first crotch strap can have a pair of first strap connectors each configured to engage one of the belt connectors in the first harness configuration. The second crotch strap can have a pair of second strap connectors each configured to engage one of the belt connectors in the second harness configuration.

In one example, a child seat according to the invention can have a pad insert that covers the first crotch strap when installed on the seating surface.

In one example, a child seat according to the invention can have two separate belt straps and can have two slots are formed through the pad insert. One of the belt straps can be threaded through each of the slots when the pad insert is installed on the seating surface.

In one example, a child seat according to the invention can be carried on a seat support and can be pivotable on the seat support between a first seat orientation with the first section as the seat bottom and a second seat orientation with the second section as the seat bottom.

In one example, a child seat according to the invention can have a clamp mechanism configured to connect the child seat to a table edge and a seat support with one end coupled to the clamp mechanism. The child seat can be pivotable on the seat support between a toddler seat orientation with the first section as the seat bottom and an infant seat orientation with the second section as the seat bottom.

In one example, a child seat for a juvenile product according to the present invention can have a seat frame mounted to the juvenile product and pivotable between a toddler seat orientation and an infant seat orientation. The child seat can have a seating surface carried on the seat frame with a first end, a second end, a seat bight, a first section between the first end and the seat bight, and a second section between the second end and the seat bight. A lap belt can be extendable from the seating surface and a toddler crotch strap can be extendable from the seating surface and connectable to the lap belt in a toddler harness configuration positioned between the first end and the seat bight. A removable pad insert can have an infant crotch strap extending therefrom. The pad insert can be installed over the seating surface. The infant crotch strap can be connectable to the lap belt in an infant harness configuration positioned between the second end and the lap belt. With the child seat in the toddler seat orientation, the toddler harness configuration can secure a child in the child seat with the first section as a toddler seat bottom and the second section as a toddler seat back. With the child seat in the infant orientation and the pad insert installed, the second harness configuration can secure a child in the child seat with the second section as an infant seat bottom and the first section as an infant seat back.

In one example, a child seat according to the invention can have an infant pad insert that covers a toddler crotch strap when installed over the seating surface.

In one example, a child seat according to the invention can have two separate belt straps forming the lap belt.

In one example, a child seat according to the invention can have two slots formed through the pad insert. One of the belt straps can be threaded through each of the slots when the pad insert is installed over the seating surface.

In one example, a child seat according to the invention can have two separate belt straps and a belt connector on an end of each belt strap. A toddler crotch strap can have a pair of toddler strap connectors each configured to engage one of the belt connectors in a toddler harness configuration. An infant crotch strap on a removable pad insert can have a pair of infant strap connectors each configured to engage one of the belt connectors in an infant harness configuration.

In one example, a child seat according to the invention can have a seat frame that is carried on a seat support and that is pivotable on the seat support between a toddler seat orientation and an infant seat orientation.

In one example, a child seat according to the invention can have a clamp mechanism configured to connect the child seat to a table edge and a seat support with one end coupled to the clamp mechanism.

In one example, the child seat according to the invention can be pivotable on a seat support between a toddler seat orientation and an infant seat orientation.

In one example, a child seat for a juvenile product according to the present invention can have a seating surface with a first section, a second section, and a seat bight region between the first and second sections. A lap belt can be coupled to the child seat and positioned near the seat bight region. A first crotch strap can be coupled to the child seat on the first section side of the seat bight region and connectable to the lap belt in a first harness configuration rendering the first section as the seat bottom of the seating surface. The child seat can have a removable pad insert with a second crotch strap extending therefrom. With the pad insert installed over the first section of the seating surface, the pad insert can cover the first crotch strap and position the second crotch strap on the second section side of the seat bight region such that the second crotch strap is connectable to the lap belt in a second harness configuration rendering the second section as the seat bottom of the seating surface.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed child seat assembly solves or improves upon one or more of the above-noted and/or other problems and disadvantages with prior art seating devices. The disclosed child seat assembly also provides one or more additional features that are not found in the prior art devices. The disclosed seat assembly provides a seating solution that can address a parent's desire to safely integrate their child effectively into the family environment during meal time and at other times, both inside and outside of the home. The disclosed child seat assembly can securely attach to a table instead of simply resting on top of the table as with a conventional bouncer seat or carrier. The disclosed child seat assembly can achieve this goal while also accommodating a child as the child grows. In one example, the disclosed child seat assembly has a child seat that can be reconfigured to accommodate infants and toddlers. In one example, the disclosed child seat assembly has a child seat with a safety harness that can secure a child in the seat during use of the seating device. In one example, the safety harness can also be reconfigured to accommodate a child as the child grows. The child seat of the disclosed seat assembly can thus be reconfigurable or convertible so as to accommodate an infant sized child in an infant seat orientation and a toddler sized child in a toddler seat orientation.

An important aspect of child development is an infant's or toddler's participation in normal functions with the family unit both inside and outside of the home. Being able to participate in such activities with the family, including meal time, reinforces the child's place as a key element in the family nucleus and also enhances the opportunity for the child to learn from example based on early and continuous family integration. In one example, the disclosed child seat assembly can operate as a bouncer for a young infant. In another example, the disclosed child seat assembly can operate as a safe and convenient feeding solution for an infant or young child that is not yet capable of sitting up or supporting their head without assistance. In one example, the disclosed child seat assembly can be reconfigured or converted so as to accommodate an older child of toddler age seated at the family table at meal time or during other family gatherings around a table or the like. Prior known safe feeding solutions or seating devices do not offer such a convertible or reconfigurable seat capable of safely accommodating different sized children at different stages of development.

Figure 1:
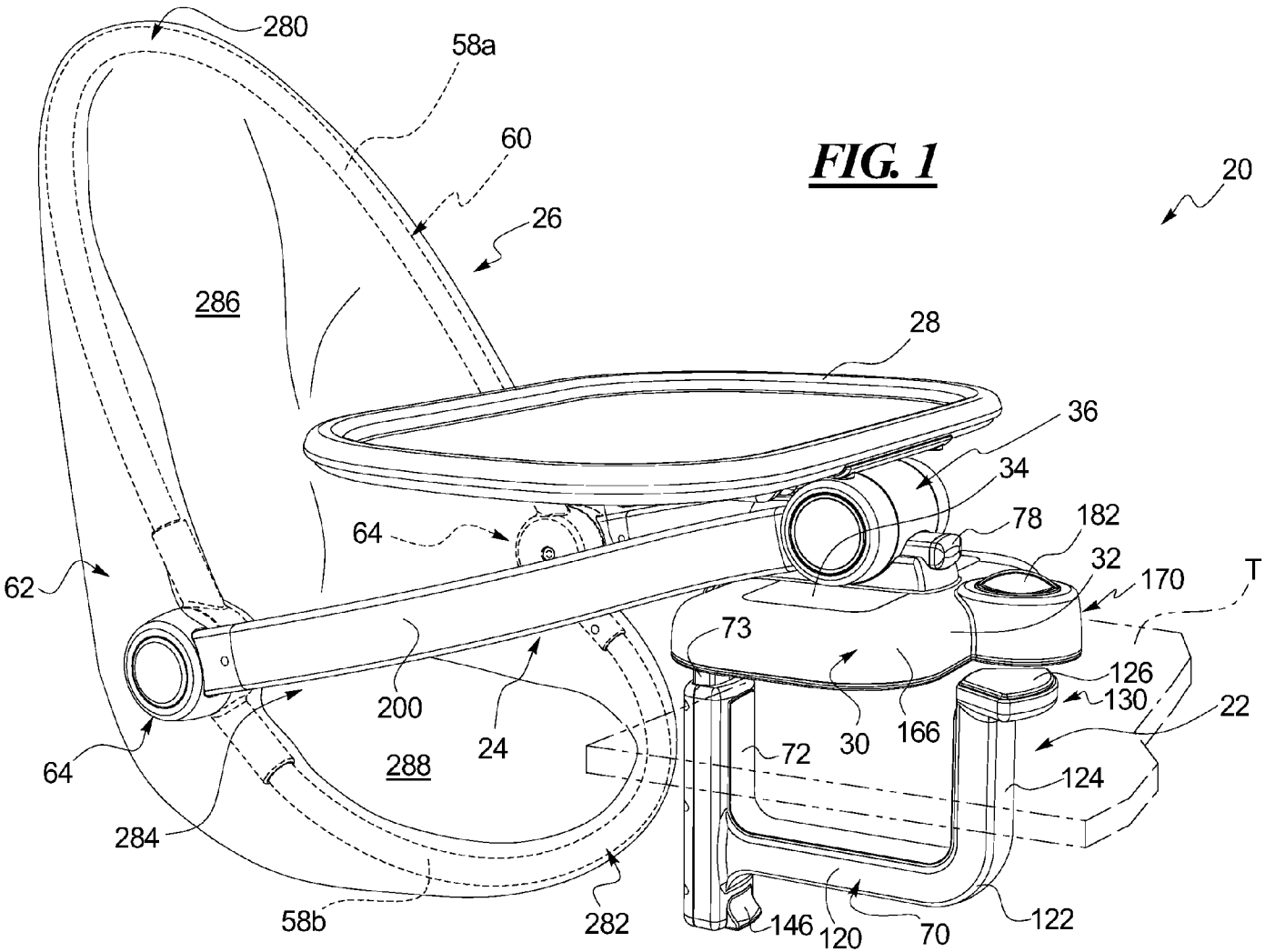
FIG. 1 shows one example of a child seat assembly constructed in accordance with the teachings of the present invention and with the child seat in a toddler seat orientation.
Figure 2:
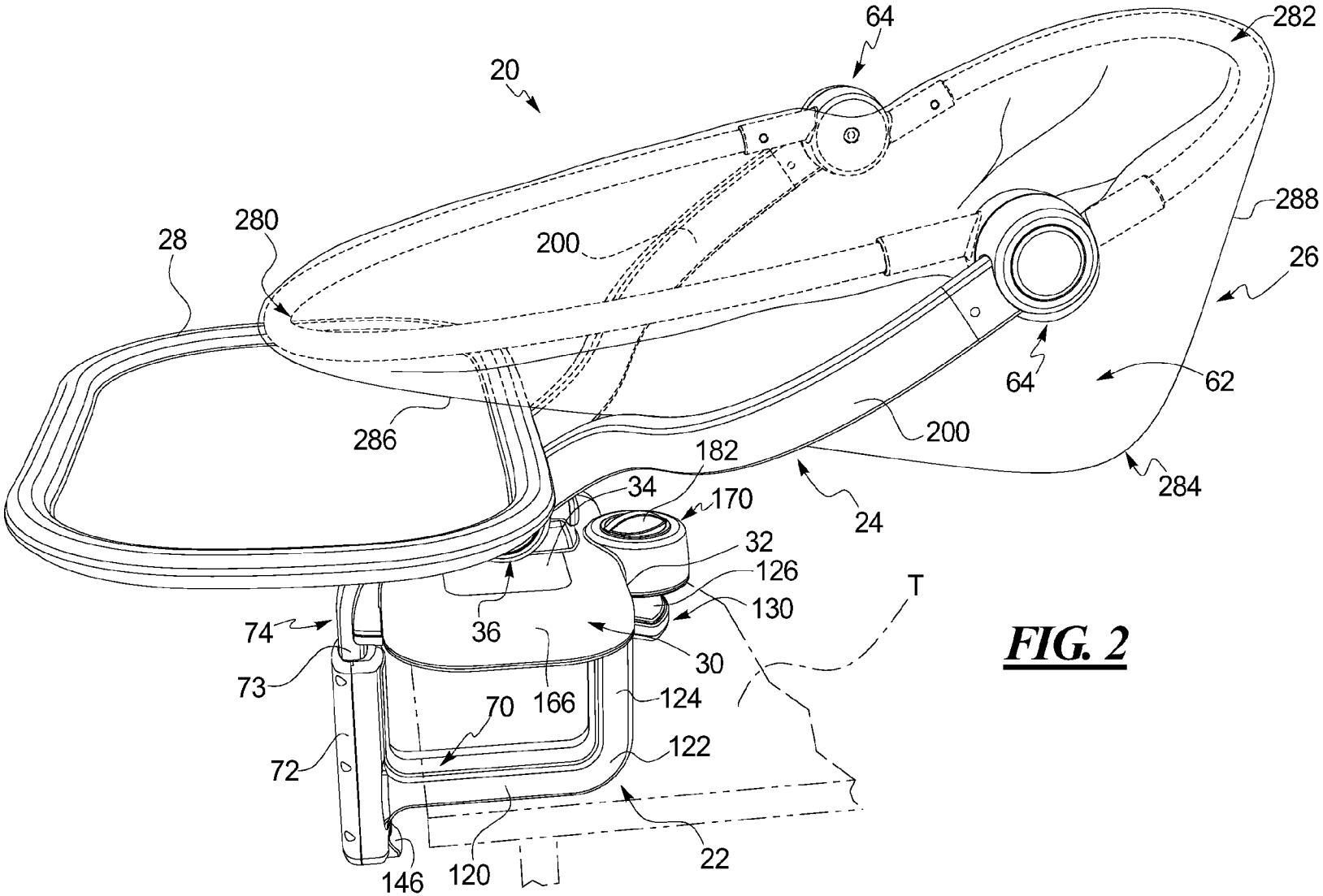
FIG. 2 shows the child seat assembly in FIG. 1 but with the child seat in an infant orientation.

Turning now to the drawings, FIGS. 1 and 2 illustrate one example of a child seat assembly 20 constructed in accordance with the teachings of the present invention. The seat assembly 20 generally has a clamp mechanism 22 that is configured to connect the seat assembly 20 to an object, such as an edge of a table T, which is shown in phantom in FIGS. 1 and 2. The child seat assembly 20 also has a seat support 24 with one end that is coupled to and movable relative to the clamp mechanism 22. A child seat 26 is supported at the opposite end by the seat support 24 spaced from the clamp mechanism 22. The seat assembly 20 also has a tray 28 in this example that can be used to hold objects, and particularly food and feeding items and implements.

Figure 3:
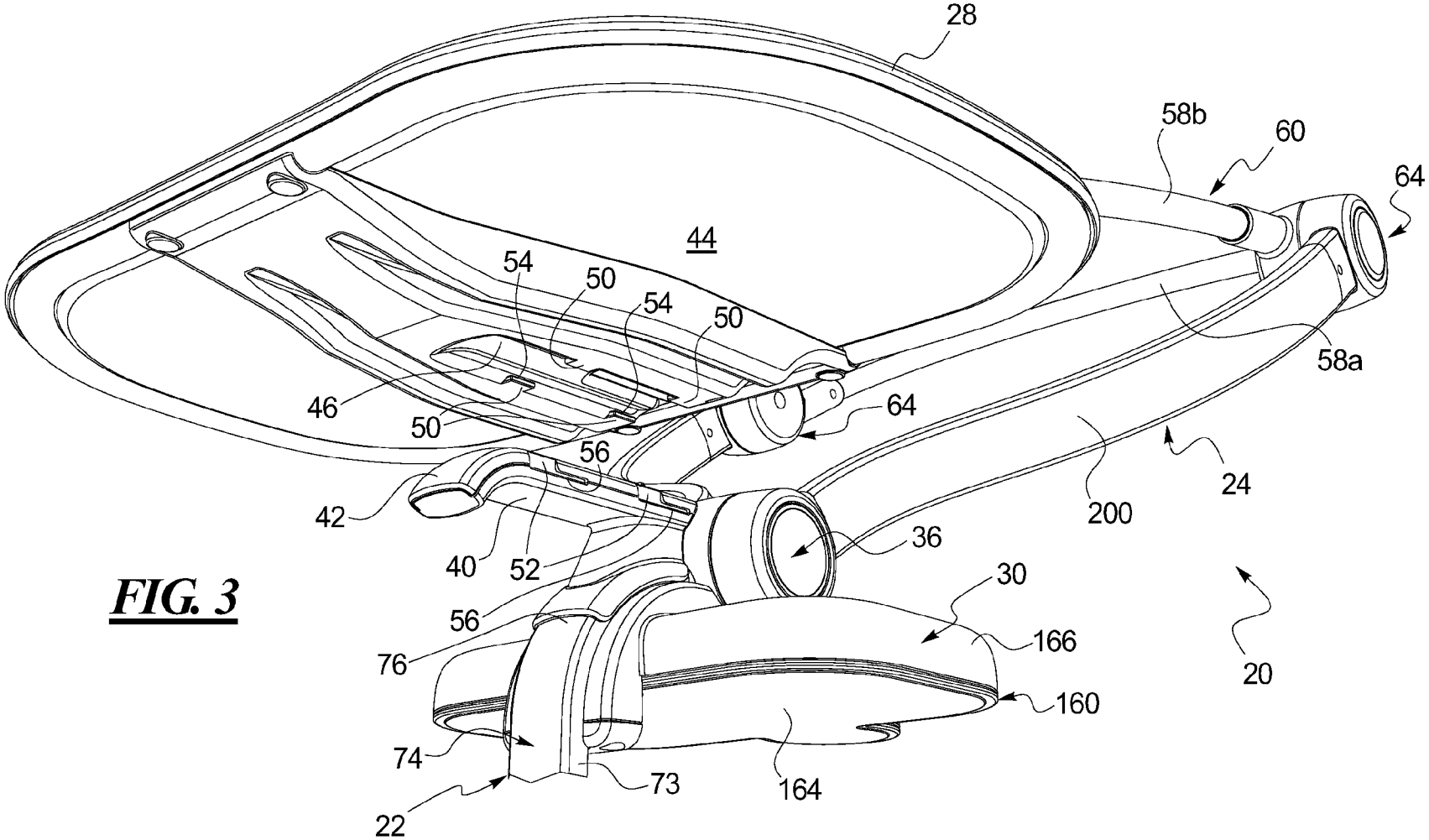
FIG. 3 shows a bottom perspective and partial fragmentary view of the child seat assembly in FIG. 2 and with the tray removed and exploded from the assembly.

With reference to both FIGS. 1 and 2, it is apparent that the child seat assembly can be repositioned, reconfigured, or otherwise converted between a toddler seat orientation shown in FIG. 1 and an infant seat orientation shown in FIG. 2. In this example, the seat assembly 20 also has a base 30 configured to rest on the tabletop surface of the table T when clamped to the table's edge. In general, the tray 28 can be removed from the assembly 20, the seat support 24 can be moved or repositioned relative to the base 30 and/or the clamp mechanism 22, and the child seat 26 can be repositioned or reoriented such that it can be selectively converted between the infant and toddler seat orientations. With reference to FIGS. 2 and 3, the clamp mechanism 22 is connected to a front end 32 of the base 30. One end of the seat support 24 is pivotally connected to a top side 34 of the base 30 at a pivot hub 36 carried on the top side.

Figure 4:
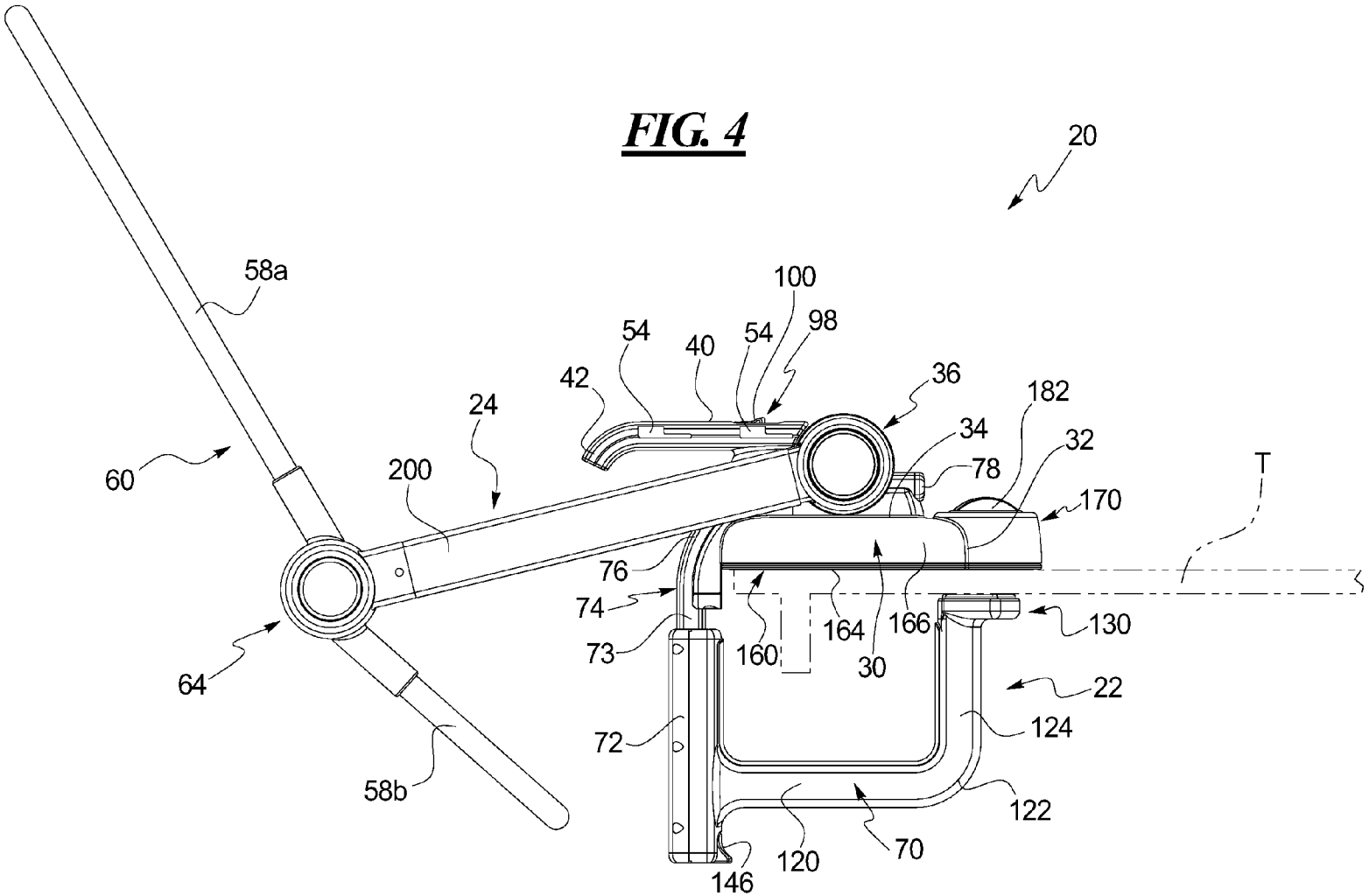
FIG. 4 shows a side view of the child seat assembly in FIG. 1 in the toddler orientation and with the tray and a seat structure portion of the child seat removed.

A tray bar 40 projects forward from the pivot hub 36 as shown in FIGS. 3 and 4. In this example, the tray bar 40 is an elongate structure curved downward at its distal or free end 42. As shown in FIG. 3, the tray 28 is removably mounted to the tray bar 40 and is shown exploded from or elevated above the tray bar. An underside 44 of the tray 28 has a recessed bar track 46 for receiving the tray bar 40. In this example, the bar track 46 has a pair of tabs 50 protruding inward from each opposed side wall of the track 46, as shown in FIGS. 3 and 4. Each side of the tray bar 40 has a pair of notches 52 that correspond in position and size with the tabs 50 on the tray. Each tab 50 has an inward or upward projection 54 and each notch 52 has an adjacent slot 56 positioned rearward of the notch in this example. The tray 28 can be installed on the tray bar 40 by aligning the tabs 50 with the notches 52 and lowering the tray until the bar bottoms out in the track 46. The tray 28 can then be pushed rearward in this example so that the projections 54 interlock with the respective slots 56 to lock the tray in place. The front end of the track 46 can also be curved to mate with the curved end of the tray bar. The tray 28 can likewise be removed by sliding the tray forward and lifting the tray from the tray bar 40. The configuration and construction of the tray bar and the mounting and locking components of the tray can vary considerably within the spirit and scope of the present invention. The size and shape of the tray can also vary.

Figure 5:
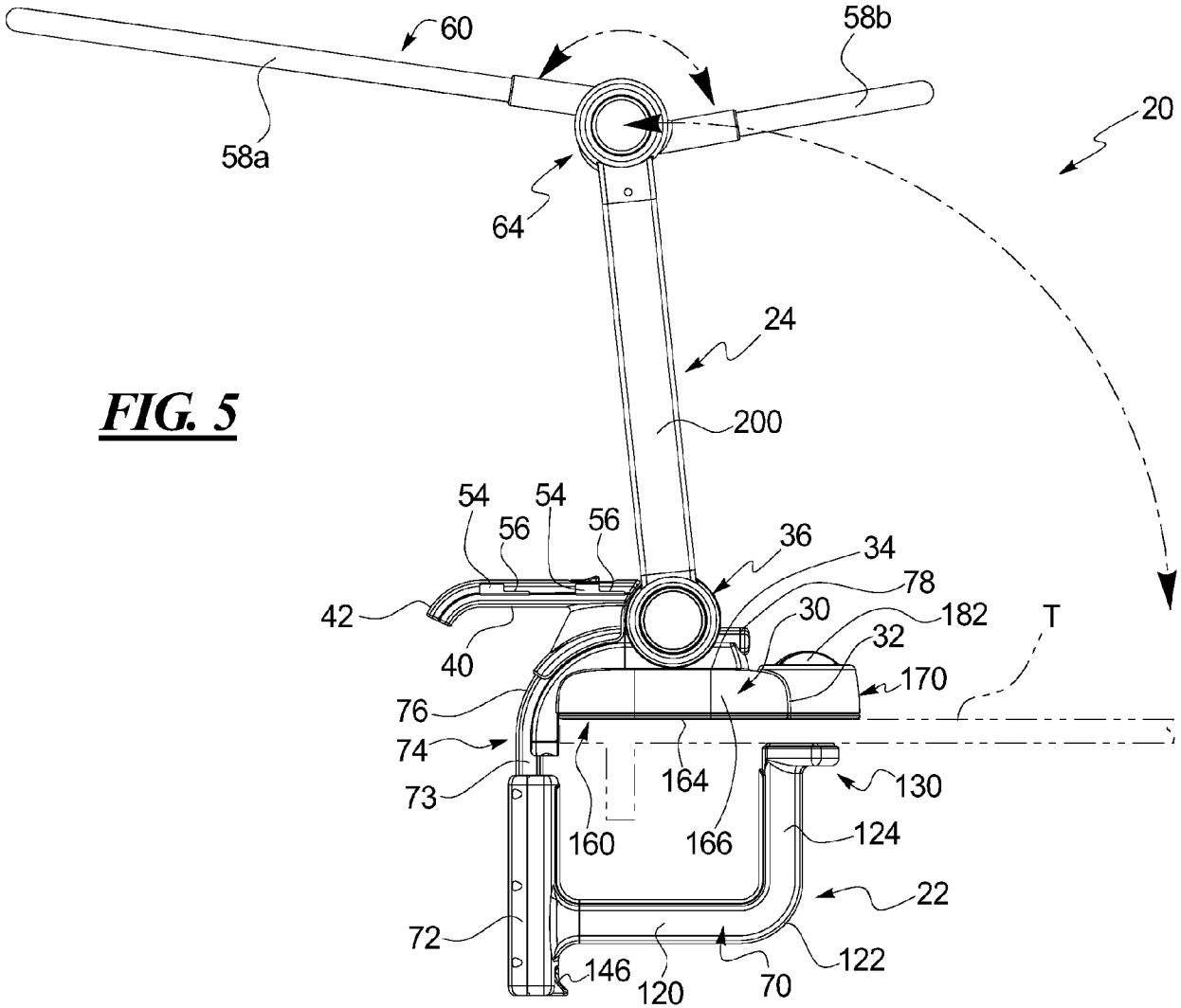
FIG. 5 shows a side view of the child seat assembly in FIG. 4 as the device is being reconfigured from the toddler orientation to the infant orientation.
Figure 6:
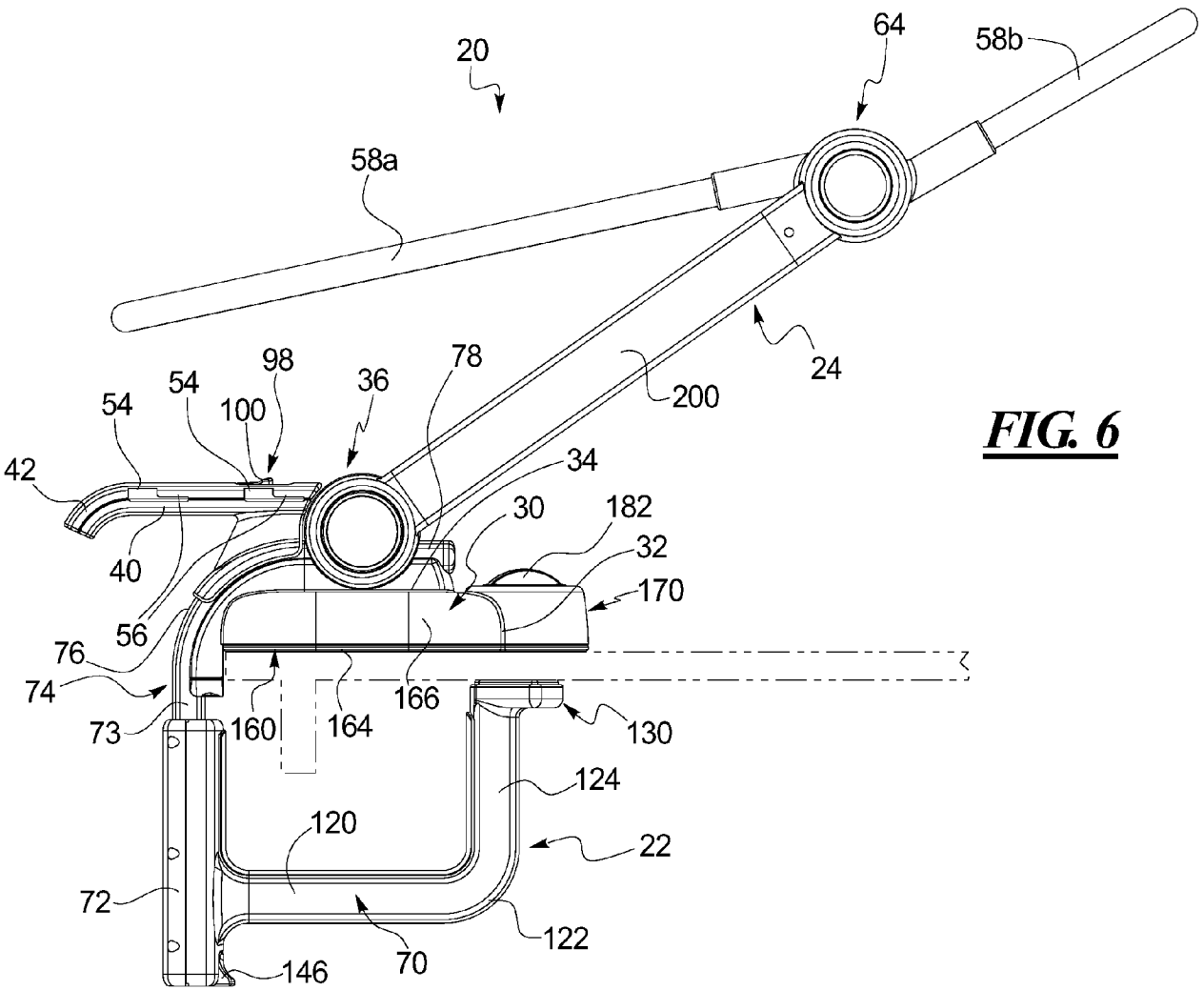
FIG. 6 shows a side view of the child seat assembly in FIGS. 4 and 5 after being reconfigured to the infant orientation.

With reference to FIGS. 4-6, the child seat 26 can be reconfigured or converted from the toddler seat orientation of FIGS. 1 and 4 to the infant seat configuration of FIGS. 2 and 6. In the example shown and described herein, the child seat 26 can be reoriented by pivoting the seat support 24 about the pivot hub 36 and by reorienting the child seat 26 relative to the support 24. In this example, the child seat 26 generally has a pair of frame segments 58*a* and 58*b* forming a seat frame 60 having an oval shape. The child seat 26 also has a seat structure 62 suspended from the frame. The seat structure 62 defines or forms the seating surface and, in one example, can be a fabric-type sling seat or the like attached to and suspended from the frame 60. In general, the seat frame 60 in this example is pivotally attached to the seat support 24 by a pair of spaced apart seat hubs 64 on the opposite end of the seat support. Each frame segment 58*a* and 58*b* is curved, forming about half of the oval shape, and has opposed free ends connected to each of the hubs 64. Thus, the seat hubs 64 are positioned on opposite sides of the child seat 26. The child seat 26 can be reoriented by pivoting the seat frame 60 relative to the seat support 24 about the seat hubs 64. As generally shown in FIG. 5, to reconfigure the seat assembly 20 the seat support 24 is pivoted about the pivot hub 36 over the base 30 in this example between the toddler and infant seat positions. In addition, the seat frame 60 is also pivoted as a unit about the seat hubs 64 between the toddler and infant seat orientations.

In general, the seat assembly 20 in this example provides a seating solution capable of accommodating different size children or a single child as the child grows. In the infant seat orientation shown in FIGS. 2 and 6, the child seat assembly 20 is configured so that the child seat 26 forms a seating surface for an infant whereby the infant is seated in a reclined position so that the infant does not need to hold up their own head. In the toddler seat orientation of FIGS. 1 and 4, the child seat 26 is reoriented or reconfigured to accommodate a child in a seated position with a more inclined seat back orientation. In this toddler seat orientation, the child will be seated generally upright.

With the tray 28 attached to the seat assembly 20 in the infant seat orientation of FIGS. 2 and 6, the tray is positioned beneath and forward of the child seat 26. The infant will not be able to readily access the tray in this orientation. The tray is thus positioned so that a caregiver can place food, utensils, feeding implements, eating receptacles, cleaning items, and the like on the tray for use while feeding the infant. In the toddler seat orientation of FIGS. 1 and 4, the tray 28 is positioned forward and above the seating surface of the child seat 26 similar to a high chair tray position. In this orientation, the child seated in the child seat 26 can directly access the tray by themselves and attempt to feed themselves. In either seat orientation, the tray 28 can be removed and the seat assembly 20 can be used simply as a tool to place their child closer to the family dynamic if seated around the table T. In another example, the seat frame 60, the seat support 24, and/or the seat hub 36 can be constructed with some resiliency so as to impart a bouncing motion upon application of an external force to the assembly in the infant seat orientation. As with a typical bouncer seat, the external force can be applied by movement of the child or by a caregiver moving a part of the seat assembly. The disclosed seat assembly 20 is thus versatile and convertible or reconfigurable between more than one seating arrangement and provides more than one feeding solution for different sized and aged children.

Figure 7:
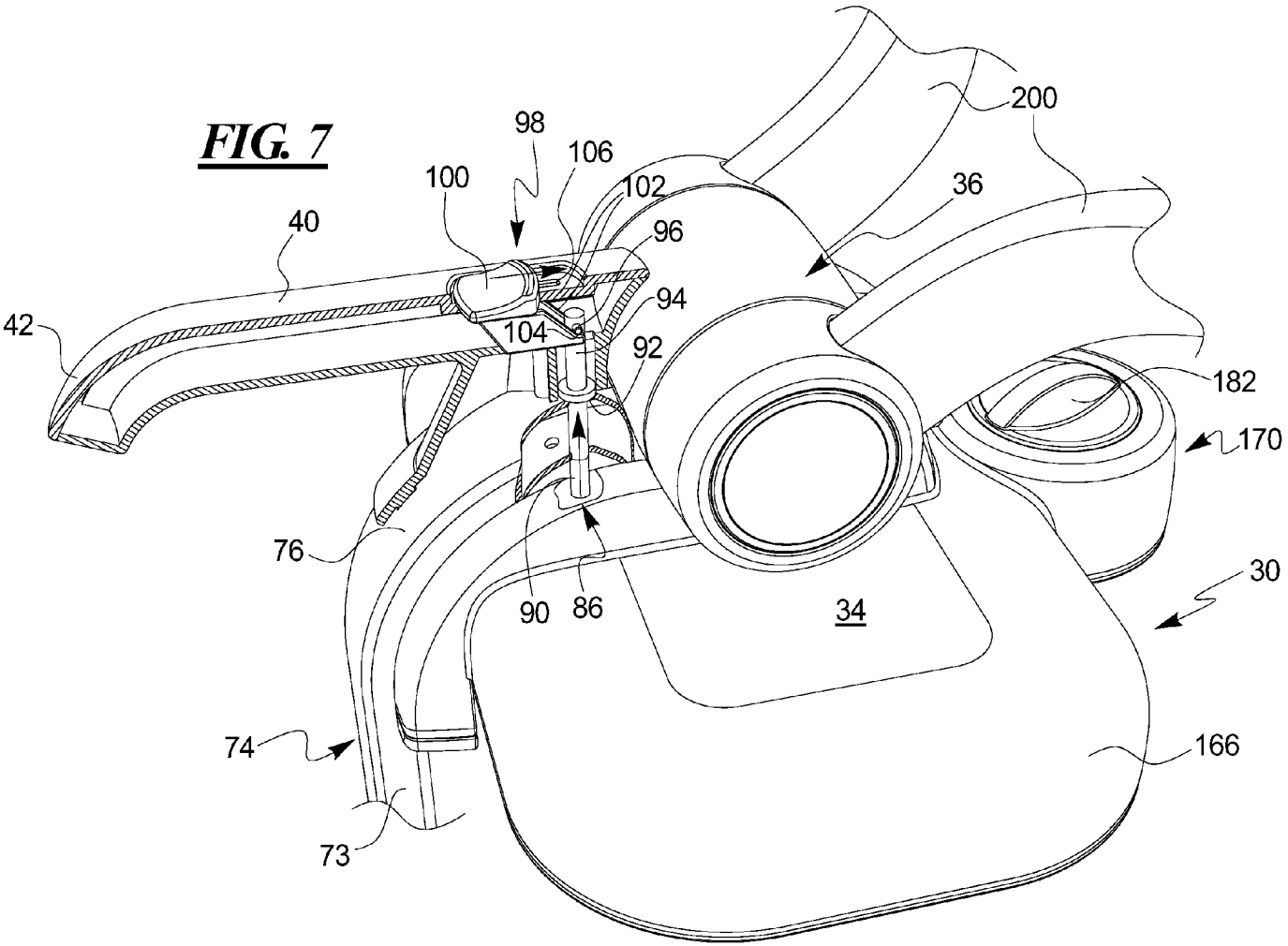
FIG. 7 shows a perspective and partial fragmentary cross-section view of a base and pivot hub portion of the child seat assembly in FIG. 6.

Details of the seat assembly 20 will now be described, beginning with FIG. 7. The clamp mechanism 22 generally has a movable jaw section 70 positioned beneath the base 30 in this example. The jaw section 70 has a vertical slide leg 72 telescopically connected to and slidable along a vertical post 73 of a mounting leg 74. The post 73 transitions into a curved mid-section or bend 76 and the mounting leg 74 terminates opposite the post end at a connector end 78. The connector end 78 is removably mounted to the base 30 in this example. A tunnel or bore 80 is formed through the lateral center of the pivot hub 36, normal or perpendicular to the pivot axis, along the lengthwise axis of the seat assembly 20. The tunnel 80 is sized to receive the connector end 78 of the mounting leg 74 as shown in FIGS. 7 and 8.

Figure 8:
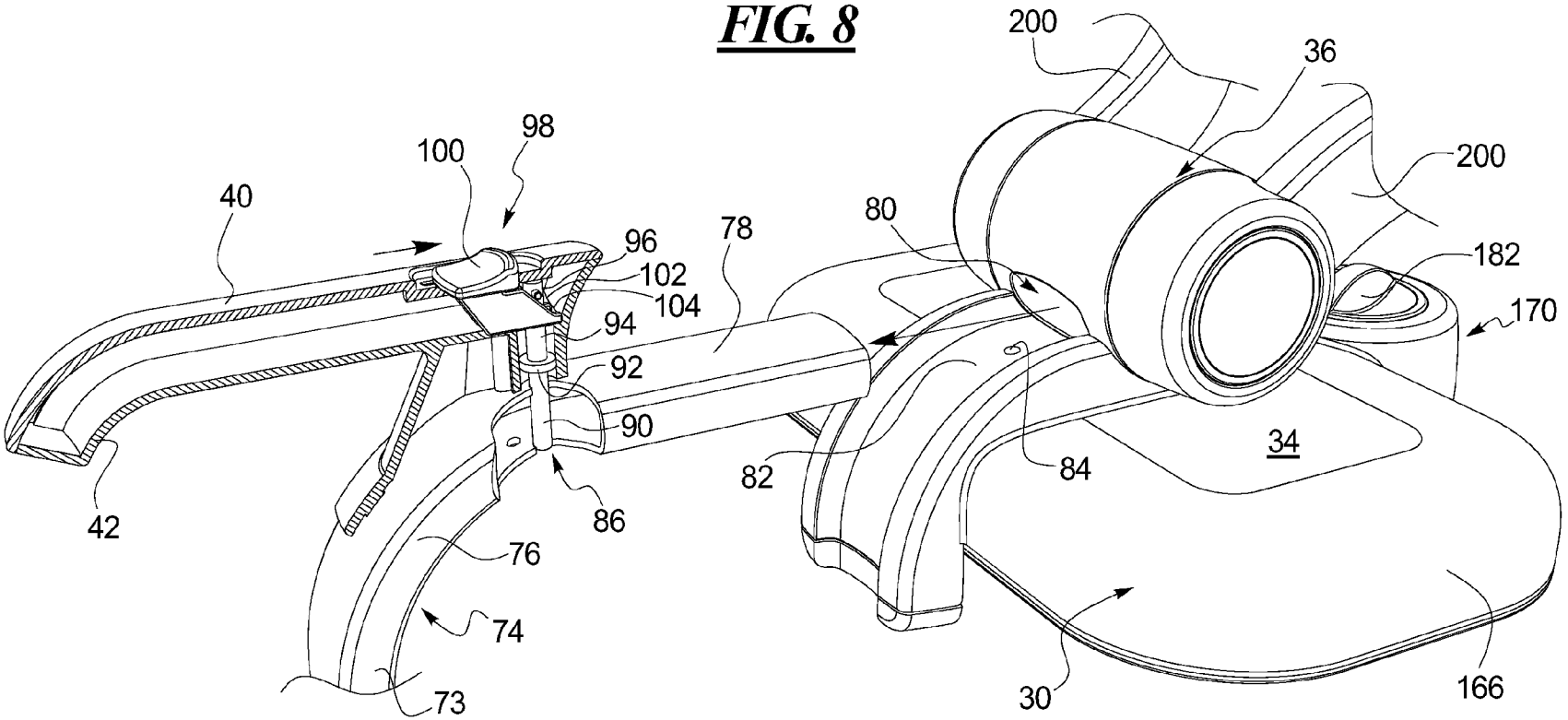
FIG. 8 shows the portion of the child seat assembly in FIG. 7 and with a clamp mechanism being detached.

As shown in FIG. 8, the tray bar 40 is attached to the mounting leg 74 near the bend 76 and is positioned above the elevation of the connector end 78. The base has a channel 82 formed at an entry to the tunnel 80 and configured to coincide with the shape and configuration on the connector end 78 as best illustrated in FIG. 8. A pin receptacle 84 is formed downward into the surface of the channel 82 near the entry to the tunnel 80. A lock pin 86 is provided on the clamp mechanism 22 and is vertically slidable within a bore. The lock pin 86 has a locking end 90 projecting downward through the connector end 78 of the mounting leg. The locking end seats in the pin opening 84 in the channel 82 when the clamp mechanism 22 is mounted to the base 30. The lock pin 86 has a fixed washer 92 separating the locking end 90 from an actuator end 94 on above the washer. In this example, a pair of laterally projecting gudgeons or stubs 96 project in opposite directions from the lock pin 86 near the tip of the actuator end 94.

An actuator 98 is slidably positioned in a recess on the top of the tray bar 40. The actuator 98 has an ergonomic contact surface 100 exposed on top of the tray bar 40. The actuator also has a pair of spaced apart walls forming cam or ramp surfaces 102 projecting down from under the contact surface 100. The lower forward ends of the ramps 102 terminate at stops 104. The gudgeons 96 rest on the stops 104 when the lock pin 86 is in the locked position of FIG. 7. To release the lock pin 86, a user apply pressure to the contact surface 100 and slide the actuator in the direction of the arrow A in FIG. 7. A guide slot 106 is provided in the recess in the tray bar 40 to guide the actuator along a linear path. When the actuator 98 is moved rearward to a release position depicted in FIG. 8, the ramps 102 will push the gudgeons 98 upward, raising the lock pin 86 to the release position where the locking end 90 of the lock pin 86 is released from the pin opening 84 in the channel 82. The entire clamp mechanism 22 can then be slid forward in the direction of the arrow C in FIG. 8 to detach and remove the clamp mechanism from the seat assembly 20 for storage. The tray bar 40 can act as a convenient handle to remove the clamp mechanism 22 and to reattach the clamp mechanism to the seat assembly 20 in a direction opposite that of the arrow C in FIG. 8. The tray bar 40 can also be used as a convenient handle to assist in mounting the seat assembly to the table T prior to installing the tray 28. The actuator 98 or the pin 86 can be spring biased by a spring 110 (shown herein on the pin 86) to the locked position of FIG. 7 such that the lock pin 86 will automatically fire back into the pin opening 84 when the clamp mechanism is reattached.

As will be evident to those having ordinary skill in the art, the clamp mechanism 22 can be attached to any suitable portion of the seat assembly 20. As noted above, in this example the clamp mechanism 22 is attached to the pivot hub 36 on top of the base 30. However, the clamp mechanism 22 could be attached directly to a portion of the base 30 or to another part of the seat assembly 20, if no such base is provided. The configuration and construction of the attachment portion of the clamp mechanism can vary within the spirit and scope of the present invention. In another example, the clamp mechanism need not be removable from the child seat 20 but instead could be formed as a component that is not intended to be removed once the seat assembly is manufactured.

Figure 9:
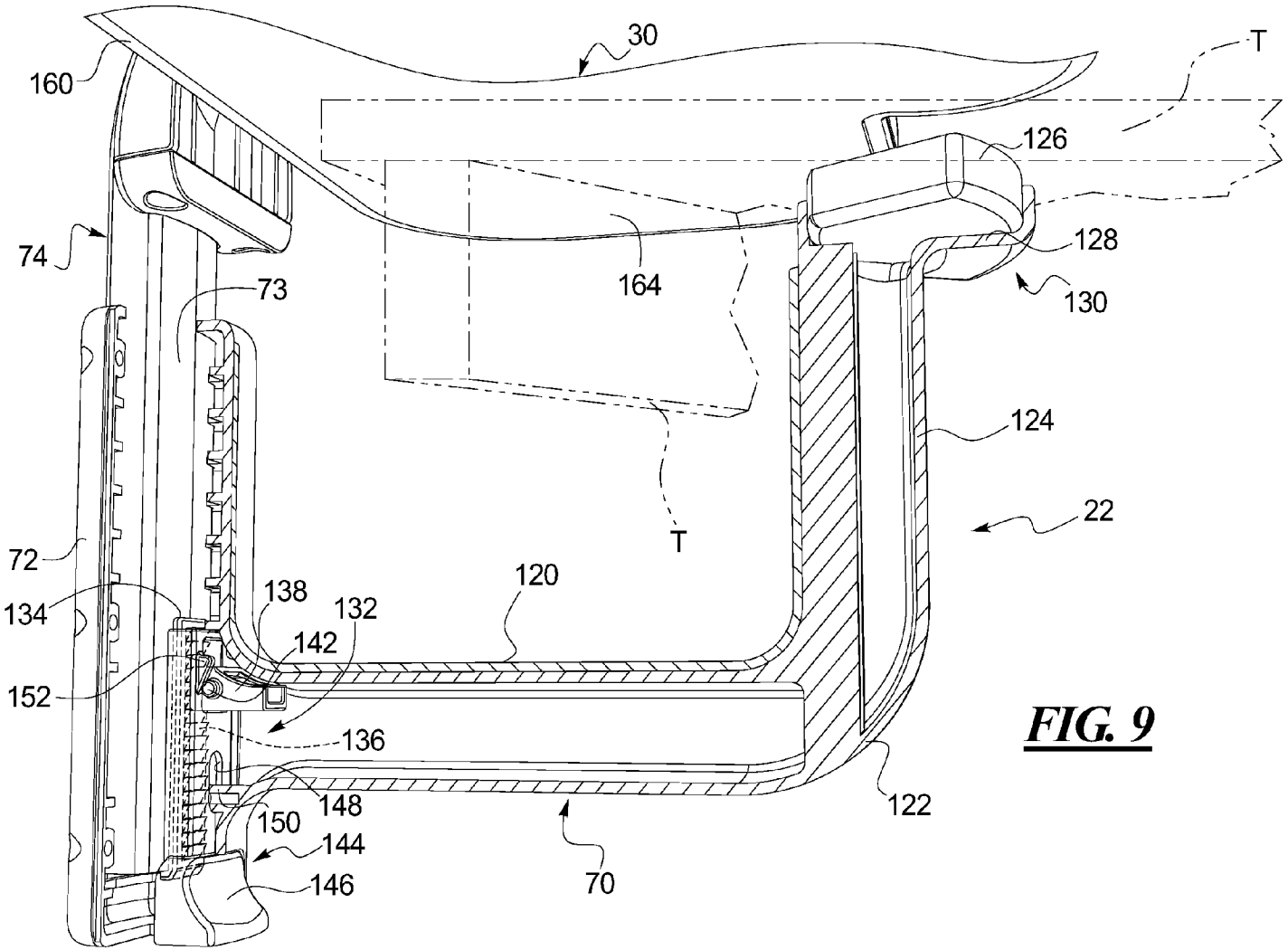
FIG. 9 shows a close-up view of a portion of the clamp mechanism of the child seat assembly depicted in FIGS. 6-8 and with the clamp mechanism in an engaged position.
Figure 10:
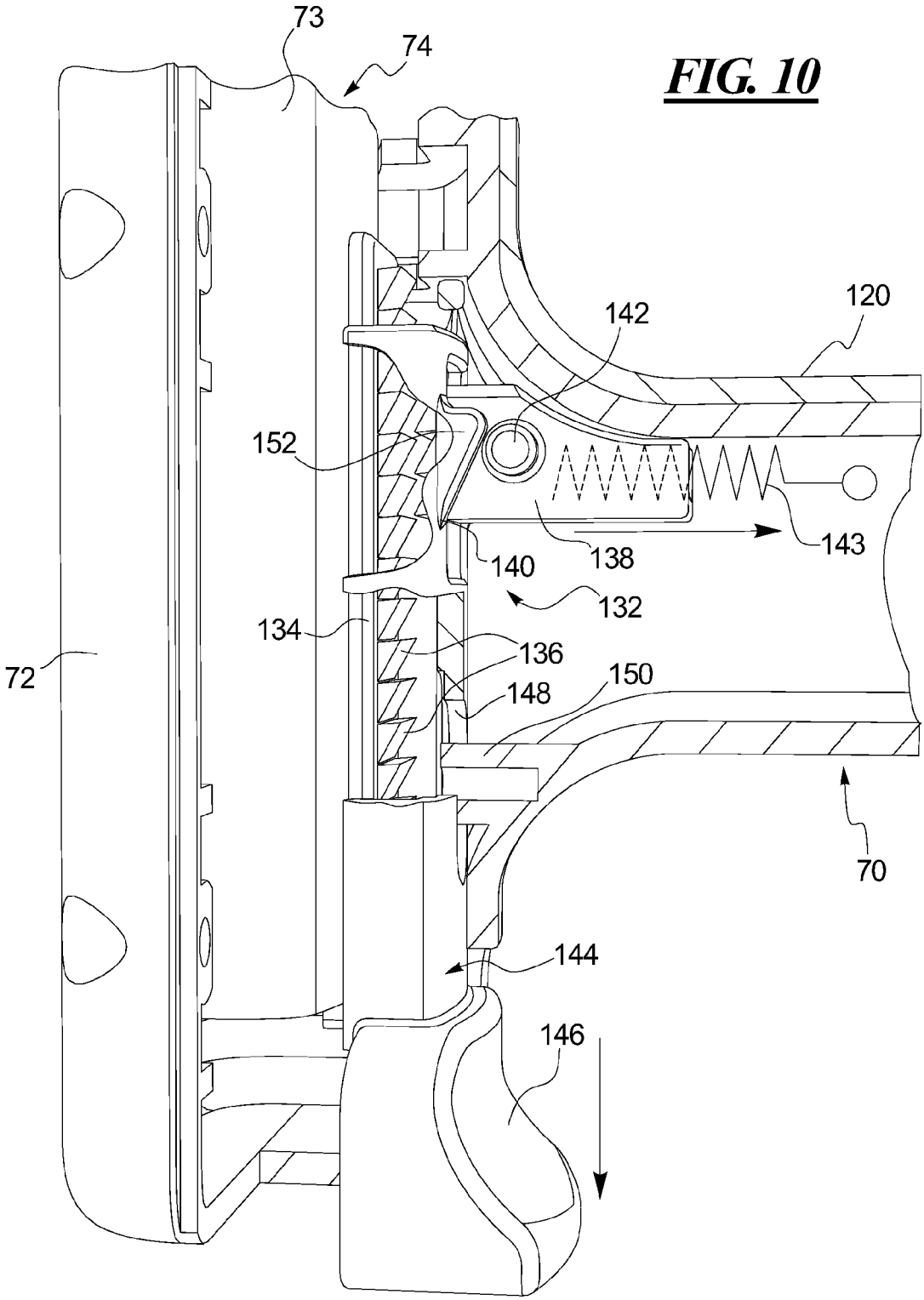
FIG. 10 shows a close-up view of the c lamp mechanism portion of the child seat assembly depicted in FIG. 9 and in a release position.
Figure 11:
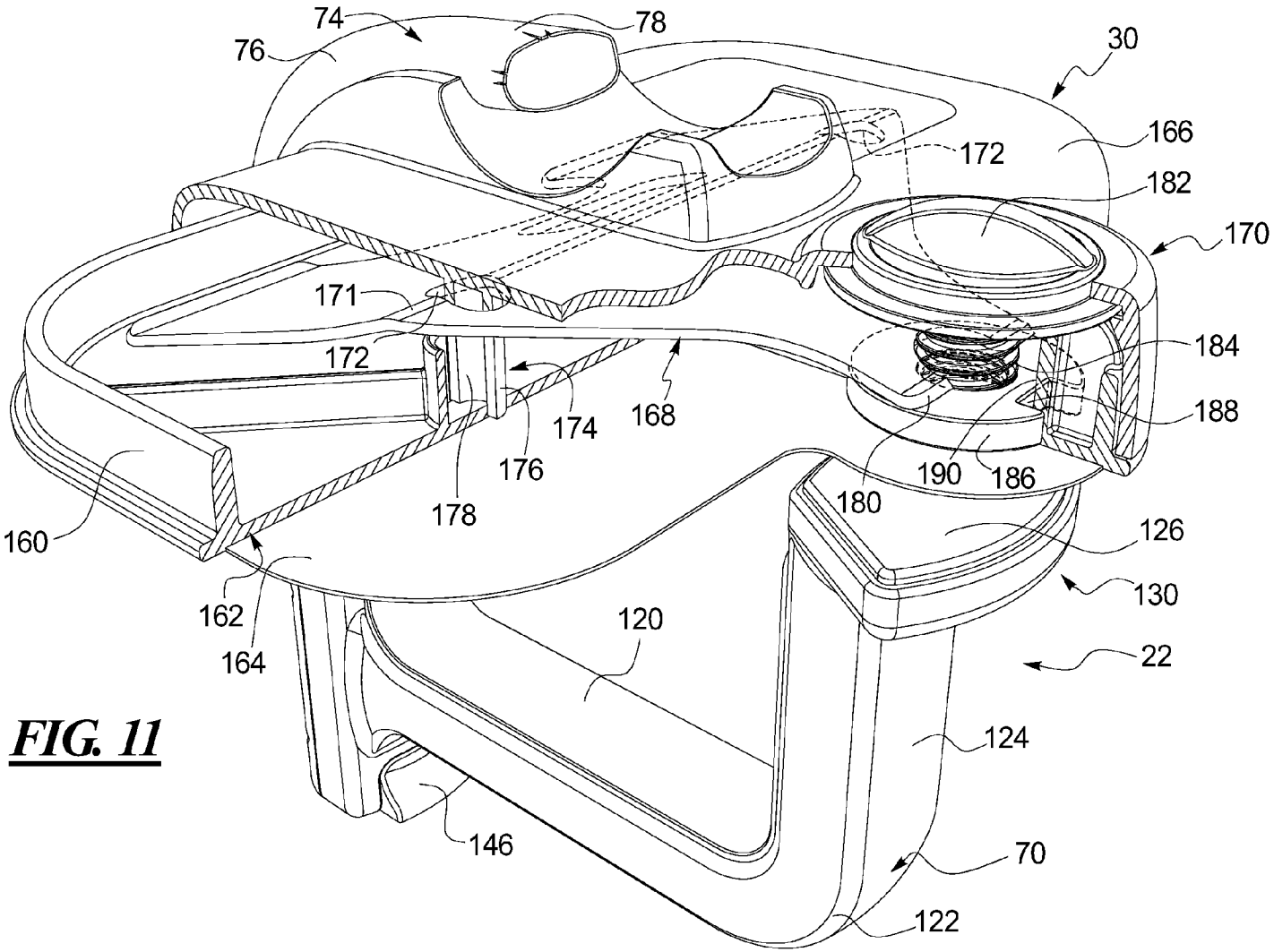
FIG. 11 shows a perspective and partial fragmentary cross-section view of another part of the clamp mechanism and base portion of the child seat assembly in FIGS. 6, 9, and 10.

With reference to FIGS. 9-11, the clamp mechanism 22 in this example has two clamping actions including a macro-adjustment and a micro-adjustment. With respect to the macro-adjust feature, the jaw section 70 can be vertically adjusted by sliding the slide leg 72 along the post 73 of the mounting leg 74. The jaw section 70 has a clamp arm 120 in this example that projects rearward away from the slide leg 72. The clamp arm 120 is oriented generally horizontally and normal or perpendicular relative to the slide leg 72. The jaw section 70 also has an elbow 122 that connects the clamp arm 120 to a vertical clamp leg 124. A clamping pad 126 is carried within a recess 128 in a foot 130 on the upper free end of the clamp leg 124. Macro vertical movement of the jaw section 70 can adjust the gap between the clamp pad 126 and a bottom side of the base 30. The clamp mechanism 22 can be opened wide to fit a variety of table styles and sizes with differing tabletop and table edge thicknesses. In one example, the T can include a wide, depending skirt S and the clamp should open sufficiently wide to fit over the skirt.

In the disclosed example, a ratchet mechanism 132 is carried in part on the slide leg 72 of the jaw section 70 and in part on the post 73 of the mounting leg 74. In this example, the ratchet mechanism 132 has a rack 134 oriented vertically and carried on the post 73. The rack 134 has a plurality of teeth 136 and is fixed in position on the post. A dog or pawl 138 is mounted to the slide leg 72 and has a tooth 140 that can engage any one of the teeth 136 on the rack 134, depending on the vertical positioning of the pawl 138. Similar to the tray actuator, the pawl 138 includes a pair of gudgeons or axles 142 projecting one each from the opposed sides of the pawl. The pawl 138 can be pivotable or slidable in order to engage or release the rack teeth. In this example, the pawl 138 is slidable in the direction of the arrow P against the biasing force of a spring 143 (schematically represented in FIG. 10. A clamp release trigger 144 has a finger grip 146 at a lower end and an elongate body 148 extending up from the finger grip. The elongate body 148 forms a U-shaped channel that encompasses the rack 134 in this example. The pawl 138 protrudes through the body to engage the teeth on the rack. The elongate body also has a slot 148 in a face of the body below the pawl 138. A stop tab 150 on the jaw section 70 protrudes through the slot 148. The stop tab and slot limit vertical travel of the clamp release trigger 144 to the length of the slot 148.

A pair of release ramps 152 projects from the face of the elongate body 148 away from the rack 134 near the upper or free end of the body. The ramps 152 engage the axles 142. A user can pull the clamp release trigger 144 downward, which causes the axles 142 to ride up the ramps and slide the pawl 138 away from the rack 134. This in turn disengages the tooth 140 of the pawl from the rack teeth 136. Once the tooth 140 is free, a user is able to lower the jaw section 70 relative to the post 73 to macro-adjust the clamp mechanism 22, i.e., open the spacing between the pad 126 and the bottom side of the base 30. Though not shown herein, the clamp release trigger 144 can also be spring biased to the upward and engaged positioned depicted in FIG. 9. The trigger can be disengaged by pushing the finger grip downward and moving the trigger against the spring biased to the release position depicted in FIG. 10. The jaw section 70 can thus be slid downward relative to the post 73 by first moving the clamp release trigger 144 to the release position. This permits a user to adjust or increase the size of a gap between the pad 126 and the base 30 so that the clamp mechanism 22 can be installed on a table. The jaw section 70 can then be slid upward until the pad 126 engages the underside of the table T. The orientation and angle of the teeth 136 and tooth 140 can be constructed as a conventional ratchet to allow the jaw section 70 to be moved upward without having to hold the clamp release trigger 144 in the release position.

As will be evident to those having ordinary skill in the art, the configuration and construction of the jaw section 70 and the macro-adjust mechanism for same can vary within the spirit and scope of the present invention. The example disclosed and described herein is for illustrative purposes. The invention is not intended to be limited to only the jaw section and macro-adjust mechanism described and shown herein.

In the disclosed example, the clamp mechanism 22 also includes a micro-adjust mechanism. Once the jaw section 70 is adjusted to fit a particular tabletop thickness when attached to the table T, the clamp mechanism 22 can be further adjusted to securely retain the seat assembly 20 mounted to the table. In this example, the base 30 has an adjustable pressure plate 160 on its bottom side as shown in FIG. 11. The pressure plate 160 has a recessed region 162 on its bottom surface into which a cushion pad 164 is seated. The pressure plate 160 is vertically movable within a base housing 166. A spring plate 168 is positioned over the pressure plate 160. The spring plate 168 has a forward end that bears against a top side of the pressure plate 160 and a rear end coupled to an adjustment mechanism 170. A mid-section 171 of the spring plate 168 is bent upward and contacts an interior surface of the base housing 166. The spring plate 168 has a plurality of slotted openings 172 near the mid-section 171. A guide post 174 is loosely seated in each of the slotted openings 172. In this example, each guide post 174 has a receiver 176 projecting up from the top of the pressure plate 160 and a guide pin 178 projecting down from the inside surface of the base housing 166 and into the receiver. The guide posts 174 loosely maintain the positioning of the spring plate 168.

The rear end of the spring plate 168 has a notched edge 180. The adjustment mechanism 170 has an adjustment knob 182 exposed on the top side of the base housing 166. A threaded shaft 184 extends down from and can rotate with the knob 182. The notched edge 180 of the spring plate 168 seats around the threaded shaft 184. A threaded collar 186 is engaged on the shaft 184 and has a notch 188. A vertical rib 190 is positioned spaced from and facing the shaft 184 within the base housing 166 below the knob 182. The rib 190 is seated in the notch 188 and prevents rotation of the collar 186. However, the rib 190 permits vertical movement of the collar along the shaft 184 along the threads on the shaft as the knob and shaft are rotated. The notched edge 180 of the spring plate 168 is positioned on top of the collar 186. Rotation of the knob 182 will move the collar 186 upward or downward along the shaft 184. Upward movement of the collar 186 will raise the notched edge 180 applying pressure to the mid-section 171 against the inside surface of the base housing 166. This pressure in turn will apply downward pressure to the forward end of the spring plate 168 to push down on the pressure plate 160. Rotation of the knob in the opposite direction will lower the collar and reduce the downward pressure of the pressure plate. Once the clamp mechanism is macro-adjusted to fit the table T, the knob can be turned to increase downward pressure applied to the pressure plate 160. This increases the clamping force of the clamp mechanism on the table T.

As will be evident to those having ordinary skill in the art, the pressure plate 160 or micro-adjust mechanism of the clamp mechanism 22 can also vary within the spirit and scope of the present invention. The micro-adjust mechanism can be provided on a portion of the jaw section 70 instead of on a base 30. Alternatively, the pressure plate 160 can vary in configuration and construction with regard to the adjustment mechanism 170, the spring plate 168, and the like. In this example, once the seat assembly 20 is attached to the table T and the jaw section 70 is macro-adjusted upward to contact the underside of the table, and knob 182 can be manipulated to increased downward pressure via the pressure plate 160 to secure the seat assembly to the table. Both the foot pad 126 and the pressure plate pad 164 can be formed of a friction enhancing material or with such surface characteristics. These pads can also provide a barrier to prevent damage to the table T surfaces.

Figure 12:
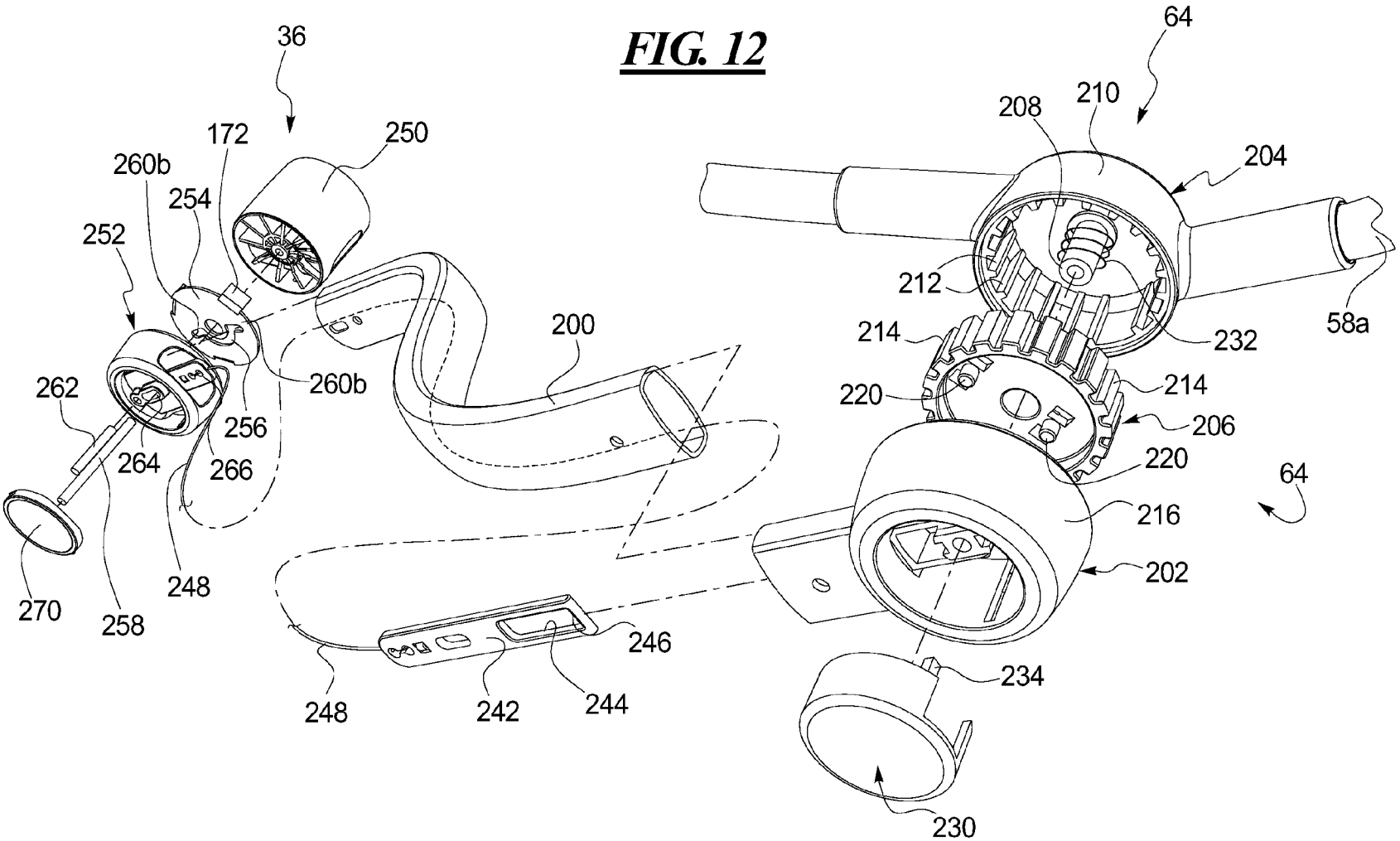
FIG. 12 shows an exploded fragmentary view of a seat pivot hub and part of a support pivot hub, a seat support, and a seat frame of the child seat assembly in FIGS. 2 and 6.

Aspects of the child seat 26 and of the seat support 24 are now described with reference to FIGS. 12-14. FIG. 12 shows an exploded view from the outside of one side of the seat support 24, including one of the seat hubs 64, the one side of the pivot hub 36, and components of a hub locking mechanism and a seat locking mechanism that are configured to releasably lock the seat support and the child seat, respectively, in a selected one of the infant or toddler orientations. In this example, the opposite side of the child seat including the seat hub, pivot hub, and hub and seat locking mechanism components is essentially a mirror image of the one side shown and described herein. However, the other side of the seat assembly need not be a mirror image of the side described below. For example, the other side may not include an actuator or seat release mechanism. It is possible that only one side of the child seat is locked via a seat locking mechanism. Other differences between the sides are also possible within the scope of the present invention.

Figure 13:
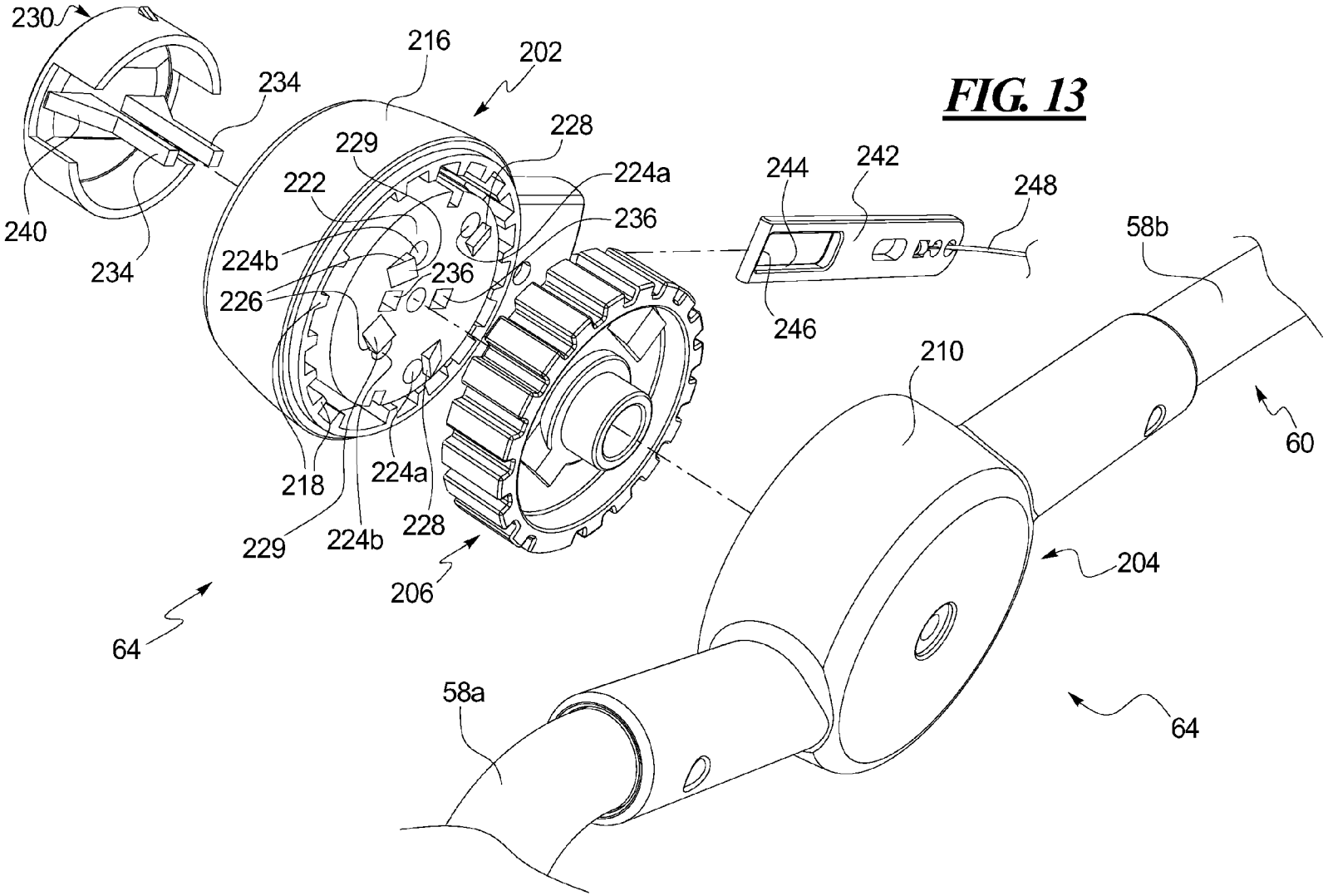
FIG. 13 shows a close-up opposite side view of the seat pivot hub and seat frame portions in FIG. 12.

FIG. 13 shows an exploded view from inside of the seat hub 64 depicted in FIG. 12. With general reference to FIGS. 2 and 7, the seat support 24 has a pair of support arms 200, each having one end connected to the pivot hub 36 and an opposite end connected to one of the seat hubs 64. In the disclosed example, the support arms 200 are arranged to form a wishbone-shaped structure defined as the seat support 24 herein. The adjacent one ends of the support arms 200 are spaced close together at the pivot hub 36 and the opposite ends are spaced apart from one another at the seat hubs 64. Other configurations and constructions of a seat support can fall within the spirit and scope of the present invention. The shape and configuration of the support arms can vary and the seat support can be constructed from a single element instead of two support arms, for example.

In this example, each seat hub 64 has a housing part 202 connected to the free or opposite end of the respective support arm 200 and a housing part 204 carried on the seat frame 60. As assembled, the housing parts 202 and 204 together define a seat hub housing with an interior cavity therein. The seat locking mechanism has a gear 206 positioned within the housing interior and mounted on a hub axle 208 that defines the seat pivot axis. The seat hub axle 208 projects in this example from an inner face of the housing part 204 on the seat frame. As shown in FIG. 12, an annular wall 210 of the housing part 204 is splined on it's inside surface and has teeth 212 that can mate with gear teeth 214 on the circumference of the gear. As shown in FIG. 13, the annular wall 216 of the housing part 202 is also splined on it's inside surface and has teeth 218 that can mate with the gear teeth 214 on the gear.

The gear 206 has a pair of locator pins 220 that project parallel to the seat hub axis from a surface of the gear that faces the housing part 202. A bearing surface 222 is positioned within the housing part 202 and faces the gear 206. The bearing surface 222 is circumferentially spaced from the splined teeth 212 and has two pairs of diametrically opposed locator holes 224*a* and 224*b* formed in the surface. A position stop 226 projects from the bearing surface 222 adjacent each of the locator holes. Each position stop 226 has a stop face 228 and a ramped surface 229 and thus is wedge-shaped in this example. The locator pins 220 will seat within one of the two pairs of locator holes 224*a* or 224*b*, depending upon which of the seat orientations is selected, as described in greater detail below.

In this example, a button or actuator 230 is seated in the outer face of the housing part 202. The button 230 can be pushed along the seat hub axis inward into the housing part 202 against the biasing force of a spring 232. In this example, the spring 232 is positioned on the side of the gear 206 opposite the locator pins 220. In this example, the button 230 has a pair of guide prongs 234 that extend into a pair of guide bores 236 in the body of the hub. The guide prongs 234 in this example are long enough so that when the button 230 is pushed into the housing part 202 the guide prongs force the gear 206 toward the housing part 204. In this example, the spring 232 is positioned between the housing part 202 and the gear 206 and thus biases the gear 206 toward the housing part 202.

In operation, the teeth 214 on the gear 206 are normally engaged with both the splined teeth 212 on the housing part 204 and the splined teeth 218 on the housing part 202. In the engaged position, the face of the gear 206 bears against the bearing surface 222 and seats the locator pins 220 in one of the pairs of locator holes 224*a* or 224*b*. Engagement of the gear teeth 214 with the splined teeth on both of the housing parts 202 and 204, and engagement of the locator pins 220 in the selected pair of locator holes 224*a* or 224*b*, prevents the seat frame 60 from rotating relative to the support arm 200. In one example, the locator holes 224*a* define the infant seat orientation of the seat frame 60 relative to the seat support 24 and the locator holes 224*b* define the toddler seat orientation.

In order to reconfigure or reposition the child seat 26, a user can push the buttons 230 inward. By doing so, the guide prongs 234 will push the gear 206 into the housing part 204. This will disengage the gear teeth 214 from the splined teeth 218 on the housing part 202 and will also disengage the locator pins 220 from the locator holes 224*a* or 224*b*. Once disengaged, the child seat 26 can be rotated relative to the seat support 24. As the child seat 26 is being rotated relative to the seat support 24, the locator pins 220 will ride along the bearing surface 222 and prevent the gear 206 from re-engaging with the teeth 218 in the housing part 202. When the locator pins 220 reach the home position at one of the infant or toddler seat orientations as defined by the locator holes, the pins will be prevented from traveling further by the stop surfaces 228 of the respective stop 226. The locator pins will then fire into the selected locator holes 224*a* or 224*b*.

In this example, releasing the seat locking mechanism at the hubs 64 permits rotation of the child seat 26 between one of the seat orientations. In this example, releasing the seat locking mechanisms also releases the hub locking mechanisms at the pivot hub 36 to permit rotation of the seat support 24 as well. The components of the hub locking mechanism are now described with reference to FIGS. 12-14. As shown in FIG. 13, the button 230 has a wedge or ramp surface 240 on its inner facing surface adjacent one of the guide prongs 234. A first cable connector 242 is slidably received radially into the housing part 202 and has a large slot 244 at one end. The guide prongs 234 and the ramp 240 are captured within the large slot 244. The ramp 240 bears against an end or edge 246 of the slot 244. An opposite end of the first cable connector 242 is coupled to a cable 248 in a conventional manner. In the disclosed example, the support arms 200 are hollow such that the cables 248 on each side of the seat support 24 can be routed through the respective support arm from the cable connector 242 down to the pivot hub 36.

Figure 14:
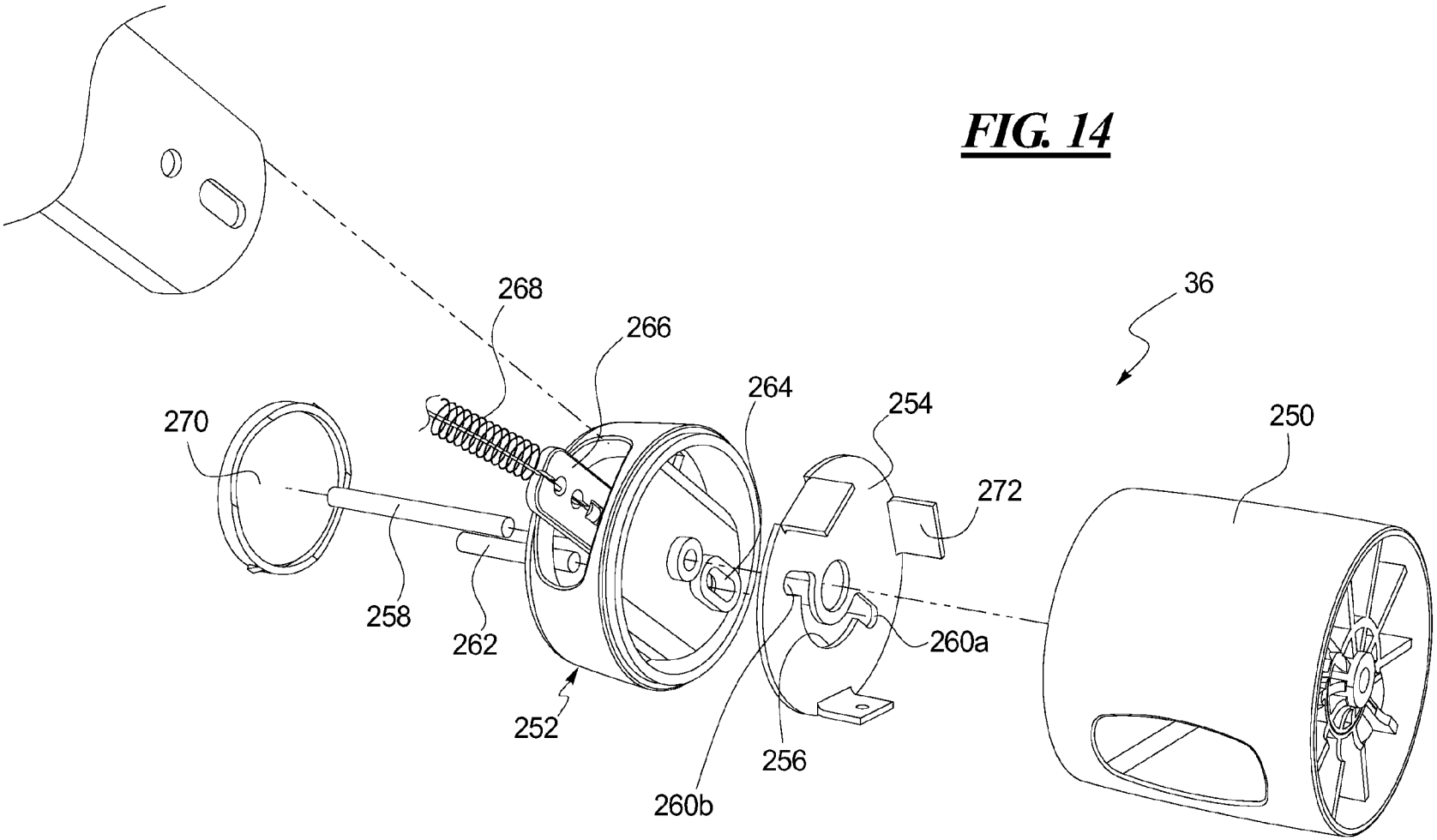
FIG. 14 shows a close-up opposite side view of the support pivot hub portion and part of the seat support in FIG. 12.

FIGS. 12 and 14 show one side of the pivot hub 36 and a pivot hub center housing 250. A hub cap 252 is connected to each side of the center housing 250 with only one of the hub caps being shown and described. The one end of the support arm 200 is connected to the hub cap 252 and extends in a radial direction as shown from the pivot hub 36. A governor plate 254 is captured between the hub cap 252 and the center housing 250. An arcuate or curved slot 256 is formed in the governor plate 254 in is spaced radially outward from a pivot axle 258 that defines the pivot axis of the pivot hub. Each end of the curved slot 256 has a radially extending notch 260*a* and 260*b*. A plurality of tabs 259 projects from the governor plate 254 into the center housing 252. The tabs rotationally fix the plate relative to the housing. A guide peg 262 extends in an axial direction through a cap slot 264 in the hub cap 252. The guide peg is affixed to one end of a second cable connector 266. An opposite end of the cable connector 266 is connected to the other end of the cable 248 in a conventional manner. The guide peg 262 is radially offset from the pivot axis and thus the axle 258 and can travel radially along the cap slot 264. In this example, a cover 270 covers the components housed within the hub caps 252.

The support arm 200 and the respective hub cap 252 can pivot relative to the center housing 250 about the axis defined by the axle 258. The guide peg 262 is seated in the curved slot 256 and can travel their along as the support arm 200 is rotated about the hub. A spring 268 (shown only schematically in FIG. 14) biases the second cable connector 266 away from the support arm 200. As the guide peg 262 reaches one end or the other end of the curved slot 256, the guide peg will be aligned with one of the notches 260*a* or 260*b*. The spring 268 will cause the guide peg to fire into the adjacent notch and prevent further rotation of the support arm 200 and hub cap 252. The spring 268 biases the second cable connector 266 away from the support arm 200, which in turn pulls on the cable 248. The cable 248 will then pull on the first cable connector 242, biasing the end 246 of the large slot 244 against the adjacent guide pin 234 on the push button 230.

When one wishes to reconfigure the seat assembly 20, the buttons 230 can be pushed in to the seat hub housings as described above. This will release the child seat 26 so that it can be re-oriented and moved to the selected toddler or infant seat orientation. By pushing the button 230, the first cable connector 242 will be drawn into the corresponding seat hub 64 via the ramps 240. The first cable connector 242 will as a result pull on the cable 248, which will draw the second cable connector 266 upward toward the respective support arm 200. This in turn will draw the guide peg 262 out of the notch 260*a* or 260*b* in which it resides and align the guide peg with the curved slot 256. This frees the guide peg 262 to travel along the curved slot 256 allowing the support arm 200 to be pivoted between the infant and toddler seat configurations or positions.

As will be evident to those having ordinary skill in the art, the configuration and construction of the seat hubs 64 and the pivot hub 36, and the seat and hub locking mechanisms, can vary within the spirit and scope of the present invention. The various components that perform the latching, releasing, engaging, and disengaging functions at these hubs can vary from the examples shown. In one relatively simple example, each of the seat hubs and the pivot hub can have its own actuators or release mechanisms instead of being functionally tied to one another by the cables 248 and the first and second cable connectors 242 and 266 as in this example. In such an example, each of the seat hubs 64 would have to be manually released and the pivot hub 36 would also have to be manually released in a separate operation. In another example, the components that retain the selected position of the seat support 24 and the selected orientation of the child seat 26 can vary from the various pins, connectors, plates, holes, stops, and other components disclosed and described herein and yet the child seat assembly 20 can function as intended.

Figure 15:
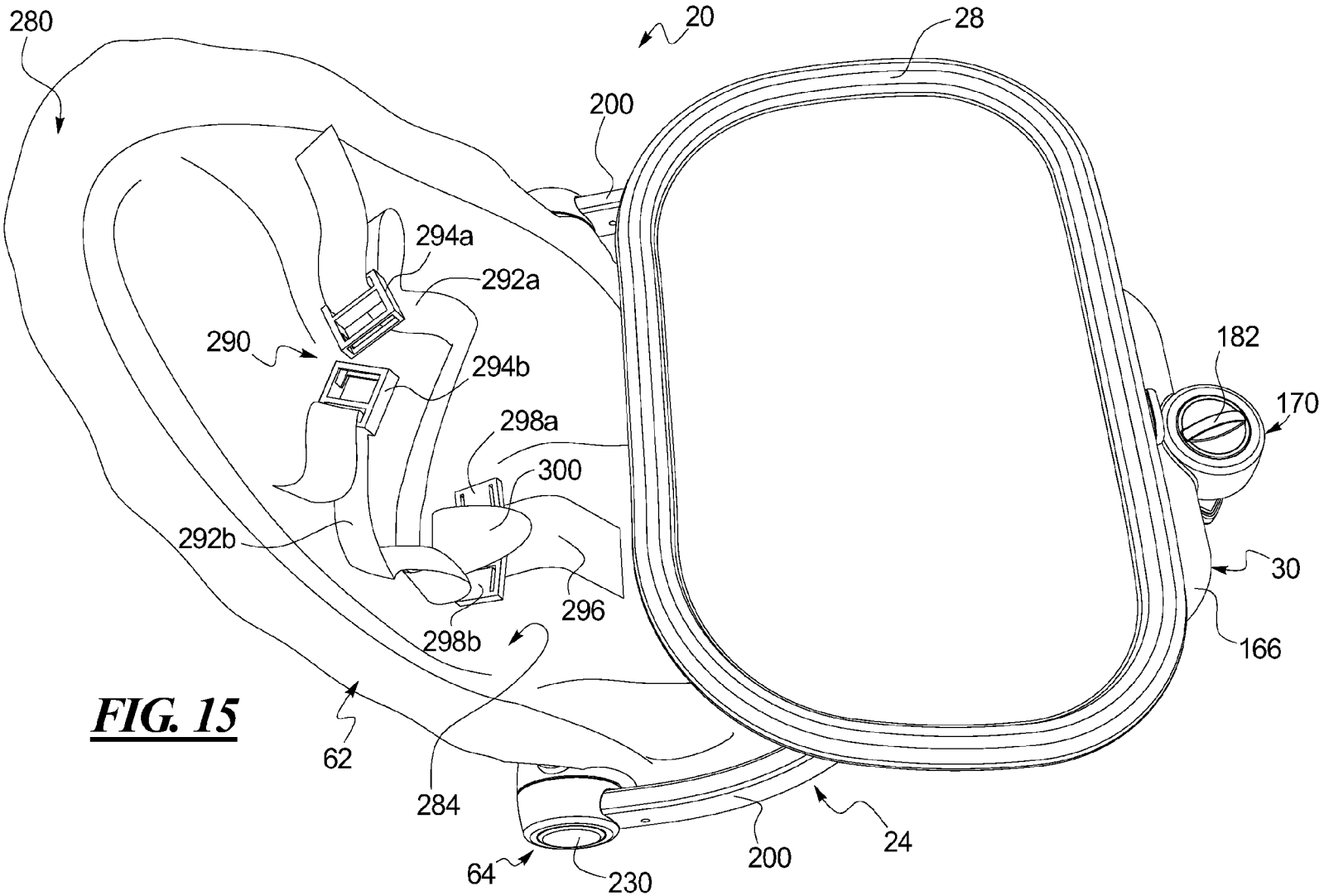
FIG. 15 shows a perspective view of the child seat assembly in FIGS. 1 and 4 in the toddler orientation and showing a toddler harness configuration.
Figure 16:
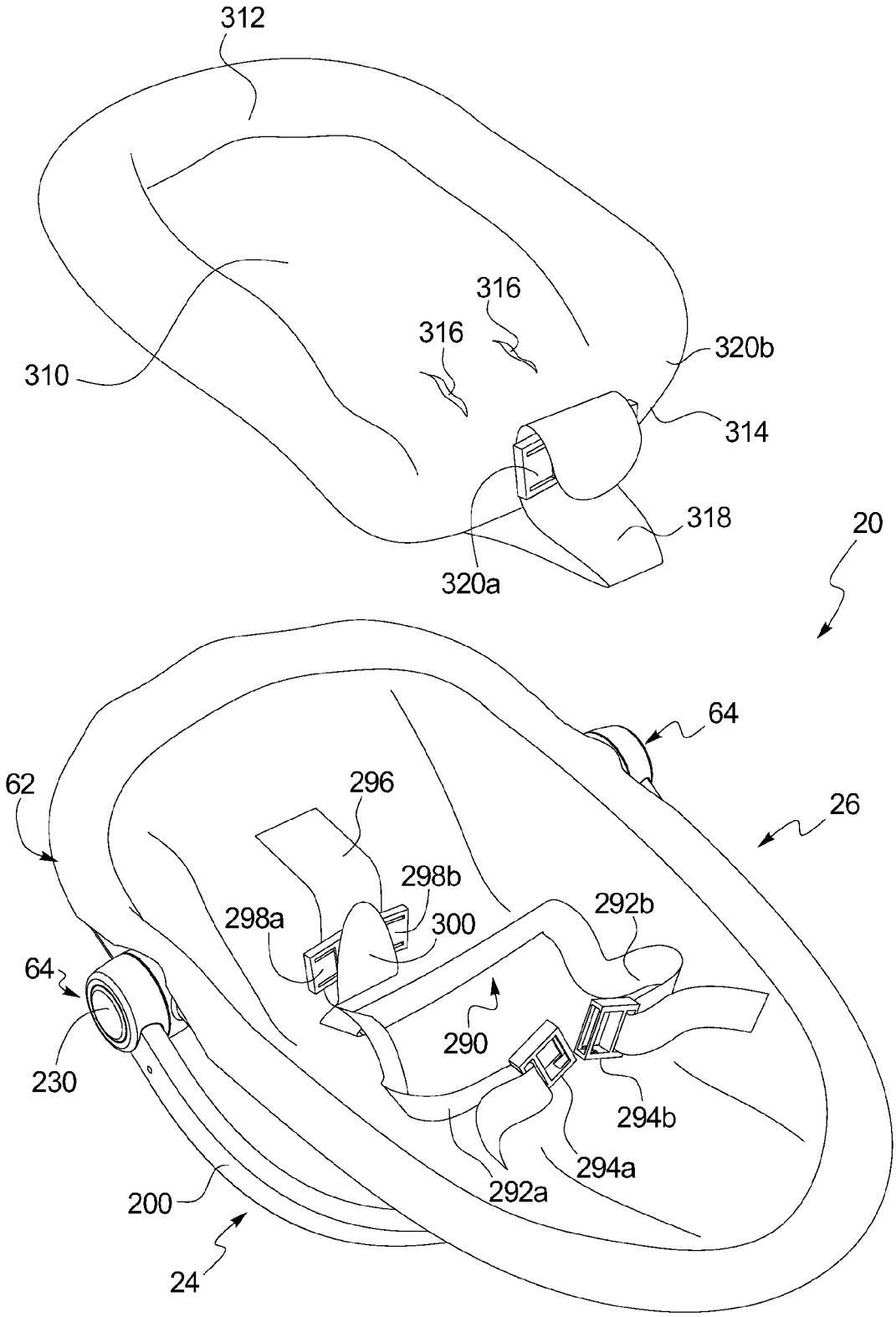
FIG. 16 shows a perspective view of the child seat of the assembly in FIG. 15 with the child seat inverted or moved pivoted to the infant orientation of FIGS. 2 and 6 and with a pad insert above the child seat.
Figure 17:
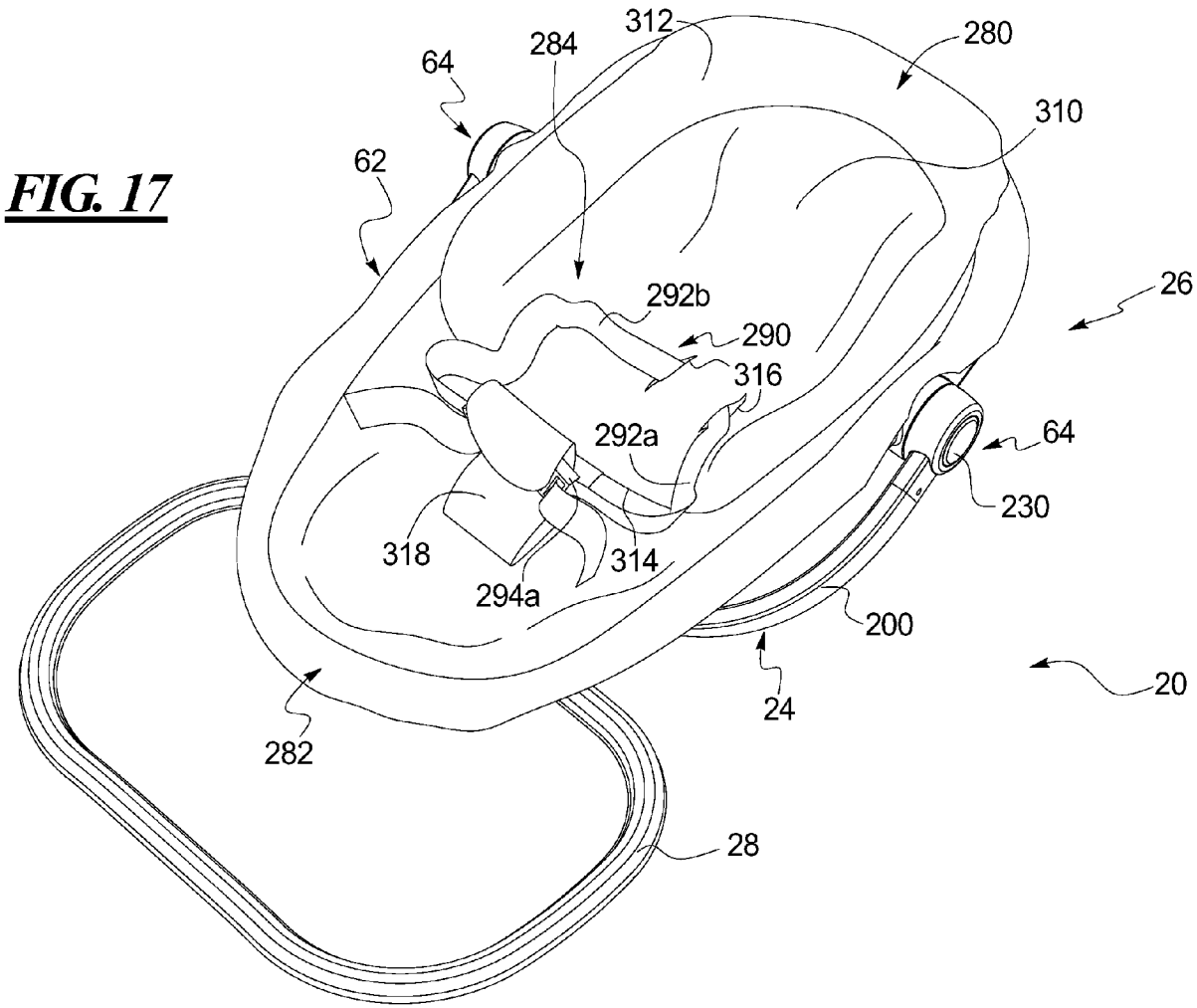
FIG. 17 shows a perspective view of the child seat assembly in FIG. 6 with the pad insert installed on the child seat and showing an infant harness configuration.

Another feature of the present invention is depicted in FIGS. 15-17. In this example, the child seat 26 is convertible or reconfigurable between the infant and toddler seat orientations. In this example, the child seat includes a seat harness that can be utilized to secure a child in the seat of the seat assembly 20. The disclosed seat harness can be reconfigured to accommodate securing a child in the child seat whether in the infant orientation or the toddler orientation. In this example, the child seat 26 includes the seat structure 62 as noted above. The seat structure 62 is mounted to and supported by the seat frame 60 and is formed of a fabric material attached to the seat frame. The seat structure 62 generally defines a seating surface with a first end 280, an opposite second end 282, and a seat bight region 284 between the two ends. A first section 286 of the seating surface is defined between the first end 280 and the seat bight region 284. A second section 288 of the seating surface is likewise defined between the second end 282 and the seat bight region 284.

As shown with reference to FIGS. 1, 4, and 15, the child seat 26 in the toddler seat orientation is oriented such that the first section 286 defines a seat back of the child seat and the second section 288 defines a seat bottom of the child seat. As shown with reference to FIGS. 2, 6, and 16, the child seat 26 is inverted in the infant seat orientation as compared to the toddler seat orientation. In the infant seat orientation, the second section 288 defines the seat back and the first section 286 defines the seat bottom of the seat. The seat bight region 284 is defined herein as a region and not as a definitive seat bight because the seat structure in this example defines a generally rounded or gradual transition between the seat back and the seat bottom in either of the seat orientations. The seat bight region 284 refers to this transition region between the seat back and see bottom in both of the seat orientations.

In this example, the seat harness has a lap belt 290 that is connected to the child seat and extendable from the seating surface. The disclosed lap belt 290 has first and second belt straps 292*a* and 292*b* each with one end coupled to a portion of the child seat. In this example, the one end of each strap 292*a* and 292*b* is coupled directly to the seating surface or seat structure 62. The opposite end of each of the belt straps 292*a* and 292*b* terminates at a belt connector 294*a* and 294*b*. In the disclosed example, a first or toddler crotch strap 296 is connected to a portion of the child seat and extendable from the seating surface. In this example, the toddler crotch strap 296 has one end that is coupled directly to the seating surface or seat structure 62. An opposite end of the toddler crotch strap 296 carries a pair of strap connectors 298*a* and 298*b*. In this example, the lap belt 290 is positioned near or at the seat bight region 284. The toddler crotch strap 296 is positioned between the first end 280 and the lap belt 290, and thus the seat bight region 284.

The toddler crotch strap 296 and a lap belt 290 can be configured to form a toddler harness configuration for securing a child in the child seat 26 in the toddler seat orientation. The belt connectors 294*a* and 294*b* can be coupled to and engaged with a respective one of the strap connectors 298*a* and 298*b* and define a pair of harness buckle assemblies in the toddler orientation. As will be evident to those having ordinary skill in the art, the configuration and construction of the buckles including the belt and strap connectors can vary within the spirit and scope of the present invention and yet function as intended. For example, the two separate strap connectors 298*a* and 298*b* can be replaced by a single buckle connector on the toddler crotch strap capable of engaging each of the belt connectors 294*a* and 294*b*. In another example, the belt connectors 294*a* and 294*b* can be configured to connect to and engage one another directly as a buckle assembly. The toddler crotch strap 296 can be configured to couple to the lap belt 290 and the buckle assembly in such an example.

In this example, the toddler crotch strap 296 also has a fabric flap 300 at its free end that can be folded over to overlap the engaged buckles. The flap 300 can employ a fastening mechanism (not shown), such as a button, snap, hook and loop fastener, or the like, to secure the flap in place over the engaged buckles.

With reference to FIGS. 16 and 17, the child seat 26 can be converted from the toddler seat orientation to the infant seat orientation and can be reconfigured to safely and comfortably accommodate an infant. In this example, an infant pad insert 310 is provided that can be attached to the seating surface of the seat structure 62. With the child seat 26 inverted, the toddler crotch strap 296 is positioned on the seat back instead of the seat bottom as it was for the popular seat orientation. Thus, the toddler crotch strap 296 is ineffective for use in configuring the seat harness to secure an infant to the child seat 26. The infant pad insert 310 can thus serve two purposes in this example. One purpose is to provide a more comfortable seating surface and to position a head support 312 on the perimeter of the pad insert 310 around the seat back or second section 288 of the seating surface. Another purpose is to reconfigure the seat harness of the child seat 26 to accommodate the infant.

In this example, the pad insert 310 has a lower edge 314 that is positioned adjacent the seat bight region 284 when installed on the child seat 26. The pad insert 310 has a pair of laterally spaced apart slots 316 spaced from but near the lower edge 314. When installed on the seating surface, the pad insert 310 is positioned over the second section 288 with a portion of the pad adjacent the lower edge 314 covering the seat bight region 284. When installed, the pad insert 310 covers the toddler crotch strap 296. The belt straps 292*a* and 292*b* can be threaded through a respective one of the slots 316 and be exposed for use as part of an infant harness configuration shown in FIG. 17. A second or infant crotch strap 318 extends from the pad insert 310 near or from the lower edge 314. In this example, the infant crotch strap 318 is constructed essentially identical to that of the toddler crotch strap 296. Thus, one end of the strap 318 is connected to the pad insert 310 and the opposite free end carries a pair of strap connectors 320*a* and 320*b*. A flap 322 is also provided on the free end of the infant crotch strap 318. The strap connectors 320*a* and 320*b* can engage a respective one of the belt connectors 294*a* and 294*b* to form a pair of engaged buckle assemblies. The flap 322 can again be folded over the buckle assemblies to cover them during use. In this example, the same lap belt 290 of the child seat 26 is utilized as part of the infant harness configuration and as part of the toddler harness configuration. The pad insert 310 covers the toddler crotch strap 296 and positions the alternate infant crotch strap 318 for use when the pad is installed. As with the first or toddler harness configuration, the second or infant harness configuration can be modified from the disclosed example within the scope of the present invention.

The harness configurations disclosed and described in FIGS. 15-17 can be employed on other types of juvenile products with seats. The seat on such products can include a lap belt configured to be used in two different seat configurations or orientations. The seat can have a first crotch strap connected to the seating surface or other part of the seat and the removable pad insert can provide a second crotch strap to replace the first crotch strap when the seat is converted or reconfigured. In an alternate example, a seat of a juvenile product, or the child seat 26, can be in an infant configuration without the seat pad insert and can be converted to a toddler seat configuration by installing the pad insert.

In the disclosed example, the seat harness can be reconfigured to secure a child in the child seat 26 of the seat assembly 20 in both of the infant and toddler seat orientations. Thus, the seat assembly 20 can provide a safe seating option for a child as the child grows without having to replace the seat assembly with another product such as a highchair, booster seat, bouncer seat, or the like. The disclosed child seat assembly 20 is reconfigurable, convertible, and adaptable to accommodate children of different sizes and ages. As discussed above, the disclosed child seat assembly 20 can also provide a reconfigurable, convertible, and adaptable feeding solution that can grow with the child or accommodate children of different sizes and ages. The seat assembly can be utilized by a caregiver to feed their young infant child and can be reconfigured so that the child can feed themselves as the child develops and grows.

In an alternate example, the seat assembly can be constructed so as to be reconfigurable in an optional bouncer seat mode and/or a rocker seat mode, in addition to the toddler and infant seat modes discussed above. In one example, such a seat assembly can have a base with a downwardly movable and repositionable clamp mechanism on the bottom of the base. In this example, the clamp mechanism can have a pair of under body hinge arms replacing the mounting leg 74 and jaw section 70 described above. Each hinge arm can be pivotally connected to a front end of the base. Each of the hinge arms can be generally C-shaped and extend forward from the front of the base, and then turn downwardly relative to the base. Each hinge arm can also have an elongate, gently and downwardly curved section that extends rearward back under the base and further behind the base. A free or tail end of each elongate section can be upturned and have a pad thereon. Each of the hinge arms can be pivotable to rotate inward and outward toward and away from one another beneath the base. In the bouncer seat configuration, the hinge arms can be pivoted away from one another. The seat assembly can rest on the gently curved elongate sections in the bouncer mode directly on a support surface. Both the base and child seat would be elevated above the support surface.

The hinge arms could be curved to allow the child seat to experience a rocker motion and/or the hinge arms could be somewhat resilient to impart a bouncing motion to the child seat. In the bouncer seat configuration or mode, the alternate seat assembly components can be formed of a relatively rigid but somewhat flexible material allowing for some degree of resilient, bouncing movement in the various components. The bounce can be caused by either the caregiver moving the device, a motor, or movement of an infant in the child seat, as is known in the art.

In another alternate example, the tray 28 can be pivotally mounted to both of the seat support arms 200 or to the pivot hub 36. Such a tray could move to different positions and orientations. In another example, the tray can be removable and replaceable on the hub in more than one optional position to accommodate more than one seat position, seat incline, seat elevation, or seat orientation. In another example, the tray can be pivotally mounted to swing sideways in an upward direction or in a horizontal outward direction out of the way. Alternatively, the tray can be mounted so that it can swing out and down out of the way if desired during use or when the seat is reconfigured or reoriented.

As noted above, the seat support 24 can vary in configuration and construction. In one alternate example, the seat support can again be cantilevered from the base or a hub on the base, as in the above described example. However, the seat support can be Y-shaped with one yoke and two support arms extending from the yoke. In such an example, the pivot hub could be altered to accommodate the lone pivot by utilizing a lone hub locking mechanism.

In another alternate example, the child seat and/or the seat support can be configured to be positionally adjustable by the caregiver, even when locked in one of the toddler or infant seat orientations. As shown, the seat back of the infant seat orientation can be more reclined than the toddler seat orientation. The seat hubs 64 can be configured to allow some adjustment of the seat recline/incline angle, when locking or after locking the child seat in one of the seat orientations. Likewise, the pivot hub 36 can also be configured to permit some degree of angular adjustment by the caregiver as well.

This could be used to raise or lower the seat height, once installed, to further adapt to a particular child and seating environment.

In one example, the seat incline for the infant seat mode can be about 45° relative to a support surface, such as the table T, but could be a different angle and/or could allow for some adjustment. The seat position can target young infants that are not yet able to hold up their own head. The purpose of the low incline position of the seat in the infant orientation is to support the developing muscles of the neck and upper body of the infant while promoting a more safe and healthy method of feeding the young infant. These muscles are not typically fully developed on an infant until about the 3-4 month age range, or later. The recline angle in combination with the seat height and seat location of the disclosed child seat assembly can allow for easier and safe feeding of the infant.

In the toddler seat orientation, the child seat can be more upright. In one example, the seat back in the toddler orientation can be oriented at approximately 90° relative to the support surface or table T on which the seat assembly is installed. In the toddler seat mode, the seating solution or child seat position can allow the child to be more upright and at eye level with the parent or caregiver during feeding or with others seated at the table. Again, the seat assembly in the toddler seat mode can provide a safe and secure seating and feeding solution.

As noted above, the clamp mechanism can also vary from the examples shown and described herein. The clamping movement should be capable of closing the gap between the clamp elements, such as the pressure plate 160 of the base 30 and the contact pad 126 of the jaw section 70 in the disclosed example. The table edge or other object should be captured or sandwiched between the clamping elements. The clamp mechanism can also employ other alternate devices and methods of allowing for the macro-adjustment, as well as the micro-adjustment, if provided. The clamp mechanism should be capable of applying adequate pressure to the top of the table or other object in order to secure the seat assembly during use.

The materials used to fabricate the components of the seat assemblies disclosed and described herein can vary within the scope of the present invention. For example, steel, plastic, aluminum, composites, fabric, wood, and/or the like can be utilized. The components in one example can be formed from aluminum, including the base, the seat frame, and the seat support arms. These components can be tubular, whether round, square, oval, or some other shape in cross-section.

The clamp mechanism can be a quick release clamp with a larger release trigger and the clamp actuators can vary and embody many different mechanisms and devices. The clamp mechanism can be configured to permit the seat assembly to be attached to a chair or other object, as well as to a table as described herein. The clamp mechanism and the hub and seat locking mechanisms can be single trigger lock/release mechanisms and the clamp mechanism could employ a "Vice Grip" type clamp. The pad and/or the pressure plate of the clamp mechanisms, or other clamp components can also be configured to allow some height adjustment as well. The disclosed seat assembly can employ quick release clamps as well as a passive back up system both for attachment to the table and for attachment of the seat to the support arms and/or the base.

The construction of the child seat can also vary, but in one example can have a fabric material slung from the oval seating tube. The seat can also be removable from and reattachable to either the support arms, seat frame, base, or base hub, as desired. Also, the fabric on the seat can be removable, interchangeable, and washable. Also, the seat can be configured to swivel between the different seat modes about a vertical axis instead of pivoting about a horizontal axis as described above. The seat frame, seat structure, or seat hubs can also be configured to allow some height adjustment of the child seat.

The tray can be a modular construction of plastic, aluminum, and/or the like and can lock to the support arms, the base hub, or the like during use. The tray can serve as a crumb catcher or a direct feeding device depending on the seat mode or solution utilized. The tray can be configured to be repositionable on the device so that it can snap onto the base or to the seat directly, in order to serve as a crumb catcher.

The base, if provided, can also be capable of allowing angular adjustment of the seat or the seat support as well as base height adjustment. Such adjustability can aid the caregiver in placing their child in a desired seating position and can promote positive child interaction and provide a safe seating and feeding solution.

Using one or more of the above-noted alternate components, the child seat can be configured to allow the caregiver to raise and lower child seat in order to further enhance the parent child relationship during use of the seat assembly. The base and/or the clamp mechanism can allow the position of the base or seat assembly relative to the edge of the table to be selectively adjusted and readjusted depending on the child's physical maturity and desired proximity to the caregiver during use of the seat assembly. In one example, a removable carrier or infant car seat (ICS) can be configured to snap on or off of the seat support or the seat frame. The removable ICS can replace the child seat disclosed herein or can be used over top of the fabric slung seat, rendering the seat assembly further adaptable and more modular. Quick clamps can also be provided to connect or render detachable other components of the disclosed seating device, depending upon the seating options offered.

The disclosed seat assembly can offer a unique solution to problems known with earlier feeding solutions and child seating devices such as those described above. In one example, the disclosed seat assembly offers a common seating solution for children of different ages at different stages of development. Thus, one seat assembly can be used longer in the home for an individual child. In fact, it is not necessary to remove the seat assembly, once installed, to convert it from seating mode to another. The seat assembly is also removable and transportable and can thus be used outside the home. The seat assembly can be broken down for compact storage as well. The clamp mechanism can be removed. The seat frame sections could be removed from the hubs and the seat fabric is easily collapsed to further facilitate compact storage and transport of the assembly, if desired. The disclosed seat assembly can meet the needs of a child during the infant feeding stage, wherein the seat is reclined to safely and comfortable support the infant. The disclosed seat assembly can evolve into a seat suitable for the toddler feeding stage, wherein the seat is more upright and positioned off the edge of the table. This allows the disclosed seating devices to grow along with the child and/or to assist a parent or caregiver in meeting the needs of two children at different stages of development. This also provides both an economic benefit as well as a design advantage over prior known devices of this type.

Although certain child seat assemblies and seating devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child seat for a juvenile product, the child seat comprising:

a seating surface with a first end, a second end, a seat bight, a first section between the first end and the seat bight, and a second section between the second end and the seat bight;

a lap belt extendable from the seating surface;

a first crotch strap extendable from the seating surface and connectable to the lap belt in a first harness configuration positioned between the first end and the seat bight; and a removable pad insert with a second crotch strap extending therefrom whereby, with the pad insert installed on the seating surface, the second crotch strap is connectable to the lap belt in a second harness configuration positioned between the second end and the lap belt, wherein the first harness configuration can secure a child in the child seat with the first section as a seat bottom and the second section as a seat back and wherein, with the pad insert installed on the child seat, the second harness configuration can secure a child with the second section as the seat bottom and the first section as the seat back, and wherein the lap belt has two separate belt straps, two slots are formed through the pad insert, and one of the belt straps is threaded through each of the slots when the pad insert is installed on the seating surface.

2. A child seat according to claim 1, wherein the seating surface is formed by a fabric material suspended from a seat frame of the child seat.

3. A child seat according to claim 1, wherein the two separate belt straps are each connectable to the first crotch strap and to the second crotch strap.

4. A child seat according to claim 1, wherein the two separate belt straps each have a belt connector on an end of the corresponding belt strap, wherein the first crotch strap has a pair of first strap connectors each configured to engage one of the belt connectors in the first harness configuration, and wherein the second crotch strap has a pair of second strap connectors each configured to engage one of the belt connectors in the second harness configuration.

5. A child seat according to claim 1, wherein the pad insert covers the first crotch strap when installed on the seating surface.

6. A juvenile product having a child seat according to claim 1, wherein the child seat is carried on a seat support of the juvenile product and is pivotable on the seat support between a first seat orientation with the first section as the seat bottom and a second seat orientation with the second section as the seat bottom.

7. A juvenile product comprising:

a child seat including a seating surface with a first end, a second end, a seat bight, a first section between the first end and the seat bight, and a second section between the second end and the seat bight, a lap belt extendable from the seating surface, a first crotch strap extendable from the seating surface and connectable to the lap belt in a first harness configuration positioned between the first end and the seat bight, and a removable pad insert with a second crotch strap extending therefrom whereby, with the pad insert installed on the seating surface, the second crotch strap is connectable to the lap belt in a second harness configuration positioned between the second end and the lap belt;

a clamp mechanism configured to connect the child seat to a table edge; and a seat support with one end coupled to the clamp mechanism, wherein the child seat is pivotable on the seat support between a toddler seat orientation with the first section as the seat bottom and an infant seat orientation with the second section as the seat bottom, and wherein the first harness configuration can secure a child in the child seat with the first section as a seat bottom and the second section as a seat back and wherein, with the pad insert installed on the child seat, the second harness configuration can secure a child with the second section as the seat bottom and the first section as the seat back.

8. A child seat according to claim 7, wherein the lap belt has two separate belt straps.

9. A child seat for a juvenile product, the child seat comprising:

a seat frame positionable between a toddler seat orientation and an infant seat orientation;

a seating surface carried on the seat frame and having a first end, a second end, a seat bight, a first section between the first end and the seat bight, and a second section between the second end and the seat bight;

a lap belt extendable from the seating surface and having two separate belt straps;

a toddler crotch strap extendable from the seating surface and connectable to the lap belt in a toddler harness configuration positioned between the first end and the seat bight; and a removable pad insert with an infant crotch strap extending therefrom whereby, with the pad insert installed over the seating surface, the infant crotch strap is connectable to the lap belt in an infant harness configuration positioned between the second end and the lap belt, wherein, with the child seat in the toddler seat orientation, the toddler harness configuration can secure a child in the child seat with the first section as a toddler seat bottom and the second section as a toddler seat back, wherein, with the child seat in the infant orientation and the pad insert installed, the second harness configuration can secure a child in the child seat with the second section as an infant seat bottom and the first section as an infant seat back, and wherein two slots are formed through the pad insert and one of the belt straps is threaded through each of the slots when the pad insert is installed over the seating surface.

10. A child seat according to claim 9, wherein the pad insert covers the toddler crotch strap when installed over the seating surface.

11. A child seat according to claim 9, wherein the two separate belt straps each have a belt connector on an end of the corresponding belt strap, wherein the toddler crotch strap has a pair of toddler strap connectors each configured to engage one of the belt connectors in the toddler harness configuration, and wherein the infant crotch strap has a pair of infant strap connectors each configured to engage one of the belt connectors in the infant harness configuration.

12. A juvenile product having a child seat according to claim 9, wherein the seat frame is carried on a seat support of the juvenile product and is pivotable on the seat support between the toddler seat orientation and the infant seat orientation.

13. A juvenile product comprising:

a child seat including a seat frame pivotable between a toddler seat orientation and an infant seat orientation, a seating surface carried on the seat frame and having a first end, a second end, a seat bight, a first section between the first end and the seat bight, and a second section between the second end and the seat bight, a lap belt extendable from the seating surface, a toddler crotch strap extendable from the seating surface and connectable to the lap belt in a toddler harness configuration positioned between the first end and the seat bight, a removable pad insert with an infant crotch strap extending therefrom whereby, with the pad insert installed over the seating surface, the infant crotch strap is connectable to the lap belt in an infant harness configuration positioned between the second end and the lap belt, a clamp mechanism configured to connect the child seat to a table edge; and a seat support with one end coupled to the clamp mechanism, wherein, with the child seat in the toddler seat orientation, the toddler harness configuration can secure a child in the child seat with the first section as a toddler seat bottom and the second section as a toddler seat back, wherein, with the child seat in the infant orientation and the pad insert installed, the second harness configuration can secure a child in the child seat with the second section as an infant seat bottom and the first section as an infant seat back, and wherein the child seat is pivotable on the seat support between the toddler seat orientation and the infant seat orientation.

14. A child seat according to claim 13, wherein the pad insert covers the toddler crotch strap when installed over the seating surface.

15. A child seat for a juvenile product, the child seat comprising:

a seating surface with a first section, a second section, and a seat bight region between the first and second sections;

a lap belt coupled to the seating surface and positioned near the seat bight region;

a first crotch strap coupled to the seating surface on the first section side of the seat bight region and connectable to the lap belt in a first harness configuration rendering the first section as the seat bottom of the seating surface; and a removable pad insert with a second crotch strap extending therefrom and a slot formed therethrough, wherein the lap belt is threaded through the slot when the pad insert is installed over the seating surface, and wherein, with the pad insert installed over the first section of the seating surface, the pad insert covers the first crotch strap and positions the second crotch strap on the second section side of the seat bight region such that the second crotch strap is connectable to the lap belt in a second harness configuration rendering the second section as the seat bottom of the seating surface.

16. A child seat according to claim 15, wherein the lap belt has two separate belt straps each threaded through the slot.

17. A child seat according to claim 16, wherein the pad insert has two of the slots and each of the belt straps is threaded through a corresponding one of the two slots.

* * * * *